US011781314B2

(12) United States Patent
Fracassi

(10) Patent No.: US 11,781,314 B2
(45) Date of Patent: Oct. 10, 2023

(54) SYSTEM, METHOD, KIT AND MODULAR ELEMENT FOR THE DRY BUILDING OF STRUCTURES FOR CONSTRUCTIONS

(71) Applicant: Isinnova S.r.l., Brescia (IT)

(72) Inventor: Cristian Fracassi, Bassano Bresciano (IT)

( * ) Notice: Subject to any disclaimer, the term of this patent is extended or adjusted under 35 U.S.C. 154(b) by 1445 days.

(21) Appl. No.: 16/076,618

(22) PCT Filed: Feb. 24, 2017

(86) PCT No.: PCT/IB2017/051073

§ 371 (c)(1),
(2) Date: Aug. 8, 2018

(87) PCT Pub. No.: WO2017/145108

PCT Pub. Date: Aug. 31, 2017

(65) Prior Publication Data

US 2023/0193624 A1 Jun. 22, 2023

(30) Foreign Application Priority Data

Feb. 25, 2016 (IT) ..... 102016000019565
Feb. 25, 2016 (IT) ..... 102016000019579
(Continued)

(51) Int. Cl.
*E04B 2/06* (2006.01)
*E04B 2/12* (2006.01)
*E04B 2/02* (2006.01)

(52) U.S. Cl.
CPC ..... *E04B 2/06* (2013.01); *E04B 2/12* (2013.01); *E04B 2002/0254* (2013.01)

(58) Field of Classification Search
CPC ..... E04B 2/06; E04B 2/12; E04B 2002/0254
(Continued)

(56) References Cited

U.S. PATENT DOCUMENTS 3,372,519 A * 3/1968 Russell ..... E04B 1/043 52/262
3,807,116 A * 4/1974 Flynn ..... E04C 2/36 428/116
(Continued)

FOREIGN PATENT DOCUMENTS

CH 707671 9/2014
DE 4016279 9/1991
(Continued)

*Primary Examiner* — James M Ference
(74) *Attorney, Agent, or Firm* — Themis Law

(57) ABSTRACT

A modular system for dry building of structures includes a plurality of modular elements having a generally planar upper or lower wall and a plurality of side faces substantially perpendicular thereto, and further having a first end edge at the upper or lower wall and a second edge opposed thereto. Anchoring members couple the modular elements so that the planar walls cooperate to define a first plane generally parallel to or coinciding with the main development plane of the structure to be built, with each of the side faces interacting with each other. The second edges of the side faces cooperate to define a second plane generally parallel and opposed to the first plane. The anchoring members include first anchoring members that act in correspondence with the second plane to effectively counteract the tensile stresses developing in the structure due to a load acting on the first plane.

17 Claims, 24 Drawing Sheets

(30) Foreign Application Priority Data

Feb. 25, 2016 (IT) ..... 102016000019586
Feb. 25, 2016 (IT) ..... 102016000019600

(58) Field of Classification Search
USPC ..... 52/223.6
See application file for complete search history.

(56) References Cited

U.S. PATENT DOCUMENTS 3,822,519 A * 7/1974 Antoniou ..... E04B 1/3483 52/79.13
3,979,863 A * 9/1976 Hurley ..... E04C 2/044 52/584.1
4,606,165 A * 8/1986 Allan ..... E04B 1/04 52/583.1
4,894,974 A * 1/1990 Mayhew ..... E04C 2/36 52/782.2
5,157,892 A * 10/1992 Ryther ..... E04C 2/36 52/793.11
5,210,988 A * 5/1993 Shaifer ..... E04B 5/046 52/223.7
5,305,567 A * 4/1994 Wittler ..... F16B 5/0056 52/586.1
5,787,675 A * 8/1998 Futagi ..... F16B 35/065 52/745.1
6,860,073 B2 * 3/2005 Chien ..... E04C 2/521 52/220.8
7,114,300 B1 * 10/2006 Culp ..... A47B 47/042 211/186
8,161,697 B1 * 4/2012 McDonald ..... E04C 2/16 428/292.4
8,353,131 B2 * 1/2013 Freet ..... E04D 3/40 52/645
8,458,980 B2 * 6/2013 Ivanov ..... A63H 33/084 446/105
8,671,640 B1 * 3/2014 Thomas ..... E04B 2/18 52/607
9,068,351 B1 * 6/2015 Biadora ..... E04C 1/397
2007/0277465 A1 * 12/2007 Kozel ..... E04B 1/2403 52/506.07
2014/0326359 A1 * 11/2014 Bennett ..... E04B 2/16 220/661
2016/0010329 A1 * 1/2016 Marstein ..... E04C 2/46 52/302.1
2023/0193624 A1 * 6/2023 Fracassi ..... E04B 2/06 52/223.6

FOREIGN PATENT DOCUMENTS

DE 29910703 9/1999
EP 0563505 10/1993
EP 0758040 2/1997
GB 2181762 A * 4/1987 ..... E04B 1/10
GB 2330595 4/1999

* cited by examiner

SYSTEM, METHOD, KIT AND MODULAR ELEMENT FOR THE DRY BUILDING OF STRUCTURES FOR CONSTRUCTIONS

FIELD OF THE INVENTION

The present invention is generally applicable in the field of civil engineering, and it relates in particular to a modular element, a system, a kit and a method for the dry building, i.e. building without using concrete, adhesive, resins or other similar bonds, of building structures.

BACKGROUND OF THE INVENTION

Modular elements which may be coupled to dry build houses are known, for example from the international applications WO2009104047 and WO2014087352.

Said modular elements generally have a substantially parallelepiped shape and are coupled two by two through male-female systems. In particular, the known elements have a main development direction and have an upper portion with a protruding male element and a lower portion with a female seat, just like the coupling system of the known "Lego" type bricks.

The known systems foresee also the use of ties fastened/hooked to two consecutive modular elements through thread-counterthread systems or bayonet systems.

In any way, the overlapped stacking of said elements allows to create vertical walls able to support a vertical load.

Thanks to the presence of ties and/or to the convenient shifted arrangement of the elements, said walls may also withstand more to tensile and shear stresses.

The known modular elements foresee also the presence of through-holes for the passage of electric and/or hydraulic plants.

Said systems have different drawbacks.

First of all, they do not allow to build structures such as attics, balconies or beams.

The strength to the stresses acting on the wall, both due natural events like wind or earthquakes, and due to the load of one or more people leaning against the wall, is quite limited.

Besides this, the replacement of one modular element requires removing all the overlying modular elements, with the consequent self-evident increase in costs and in the time for the wall restoration.

Again, since the operator must pay a lot of attention to the arrangement of the modular elements in order not to jeopardize the structural features of the structure to be realized, the building of the wall shall be carried out by specialized staff.

Another self-evident drawback of the known systems is that, in case maintenance to the plumbing pipes or to the electrical plant located in the specific through-holes is required, the concerned wall section shall be broken, with self-evident consequences in terms of time and maintenance costs.

From the German document DE4016279 a raised floor is known which, for its technical inherent features, it is not a structure according to the present invention. In fact, it is simply a support directing to the slab, which is of the traditional type, the stresses to which it is subject.

SUMMARY OF THE INVENTION

Object of the present invention is to at least partially overcome the above drawbacks, by providing a modular system for the dry building of building structures of high efficiency and relatively cost-effective.

Another object of the present invention is to provide a modular system allowing to dry build building structures.

Another object of the present invention is to provide a system for the dry building of building structures able to greatly withstand to tensile, compressive and shear stresses.

Another object of the present invention is to provide a modular system allowing anyone to easily build a structure and, more generally, a building, in particular a house.

Another object of the present invention is to provide a system for the dry building of buildings structures being easy to assemble.

Another object of the present invention is to provide a modular system for the dry building of building structures allowing their manufacturing in a limited time period.

Another object of the present invention is to provide a modular system for the dry building of building structures able to support high loads.

Another object of the invention is to provide a demountable modular system for the dry building of building structures.

Another object of the present invention is to provide a modular system for the dry building of building structures allowing the modification of the structure once built.

Another object of the present invention is to provide a modular system for the dry building of building structures being of easy maintenance.

Another object of the present invention is to provide a modular system for the dry building of building structures particularly suitable for building houses.

Another object of the present invention is to provide a modular system for the dry building of building structures of low environmental impact.

Another object of the present invention is to provide a modular system for the dry building of building structures having a high aestethic appeal.

Another object of the present invention is to provide a modular element to be used in a modular system for the dry building of building structures being particularly effective and relatively inexpensive.

Another object of the present invention is to provide a modular element to be used in a modular system for the dry building of building structures being light and of compact dimensions.

Another object of the present invention is to provide a modular element to be used in a modular system for the dry building of building structures made of recyclable material.

Another object of the present invention is to provide a modular element to be used in a modular system for the dry building of building structures being easy to transport and/or stackable.

The above objects, and others that will appear more clearly hereinafter, are fulfilled by a modular system for the dry building of building structures and/or by a modular element to be used in said system having one or more of the features herein described, claimed and/or shown.

In a further aspect of the invention, it is provided a method and a kit for the dry building of building structures having one or more of the features herein described, claimed and/or shown.

Advantageous embodiments of the invention are defined in the dependent claims.

BRIEF DESCRIPTION OF THE DRAWINGS

Further features and advantages of the invention will become more apparent by reading the detailed description of a preferred but not exclusive embodiment of a modular system for the dry building of structures shown as non-limiting example with the help of the annexed drawings, wherein.

Figure 28A:
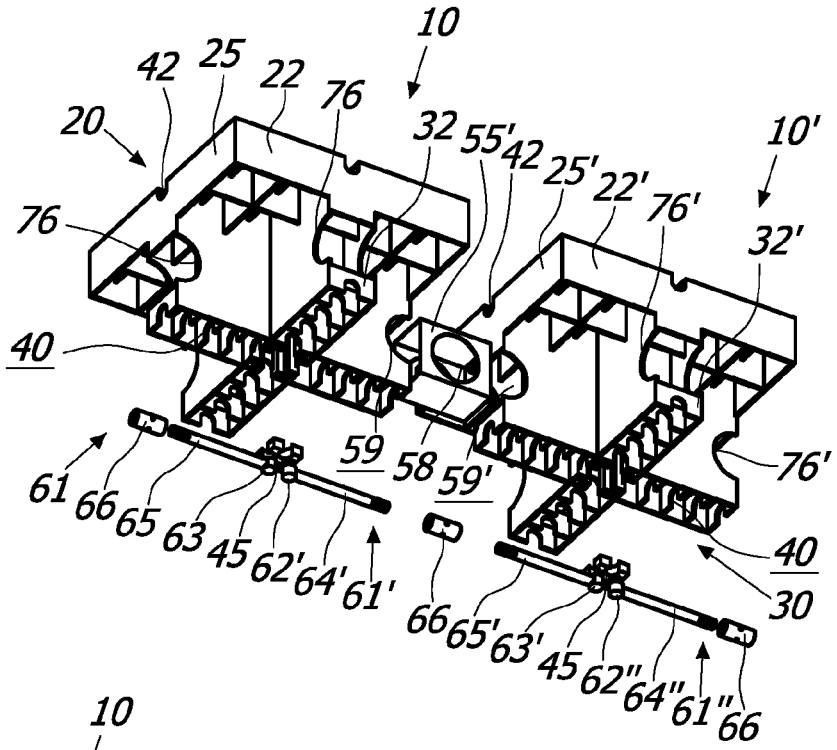
Figure 28B:
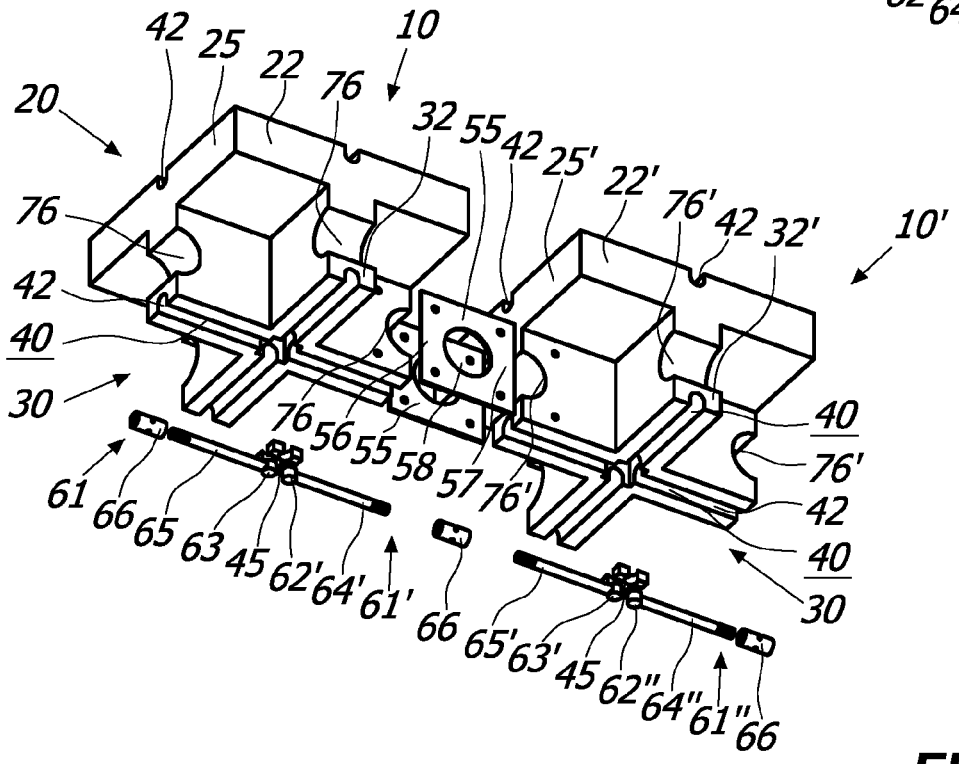
Figure 29B:
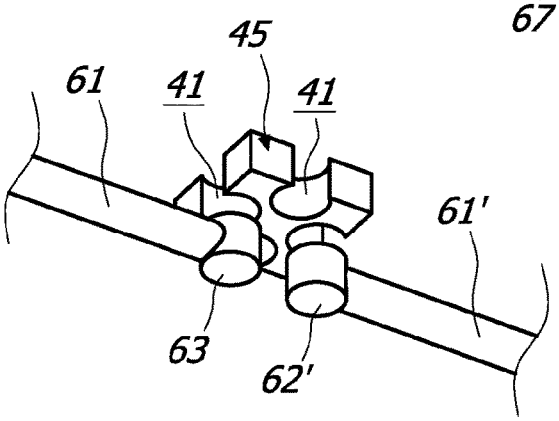
Figure 29A:
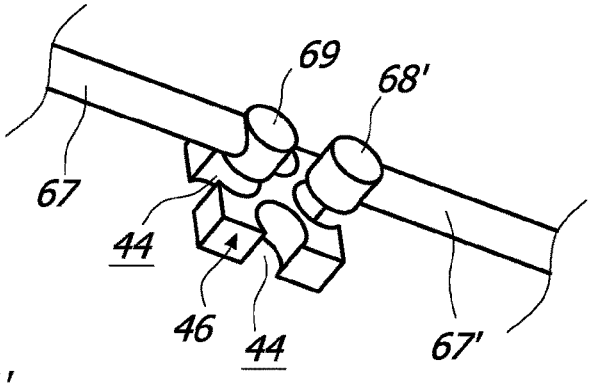
Figure 30:
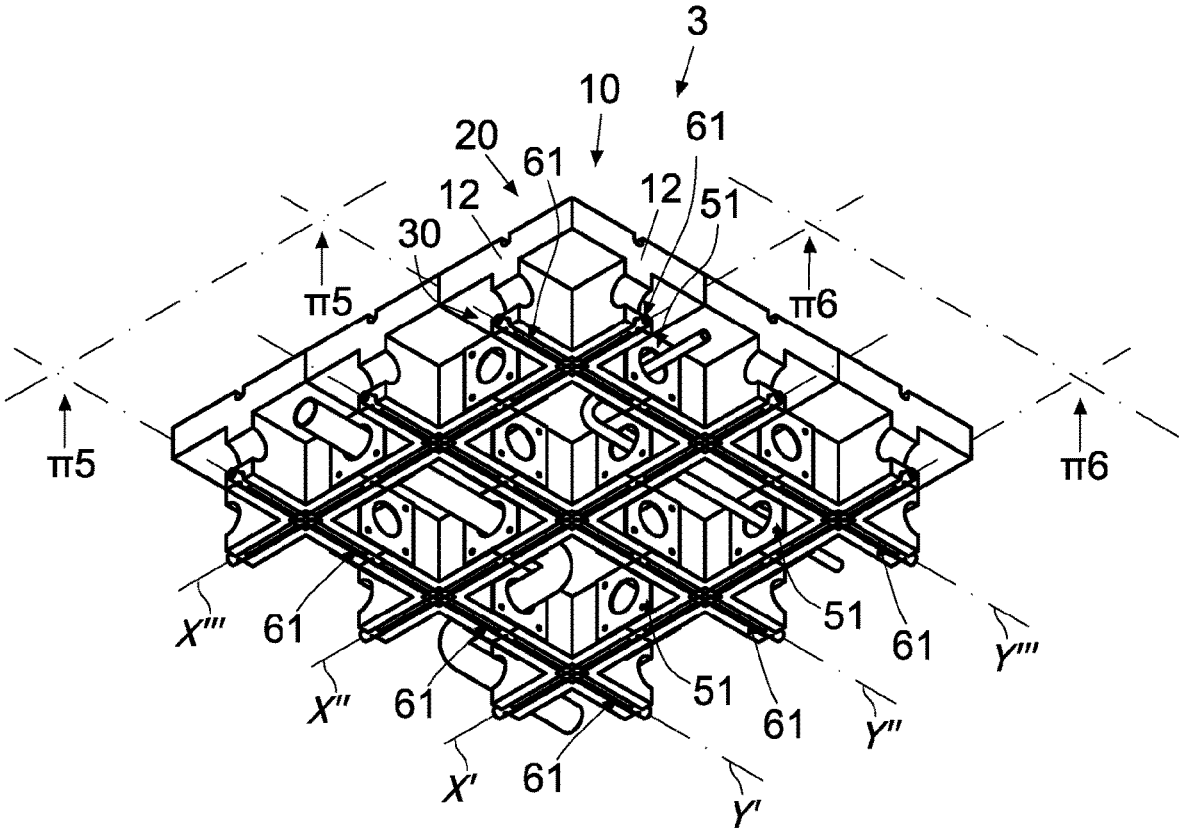
Figure 31:
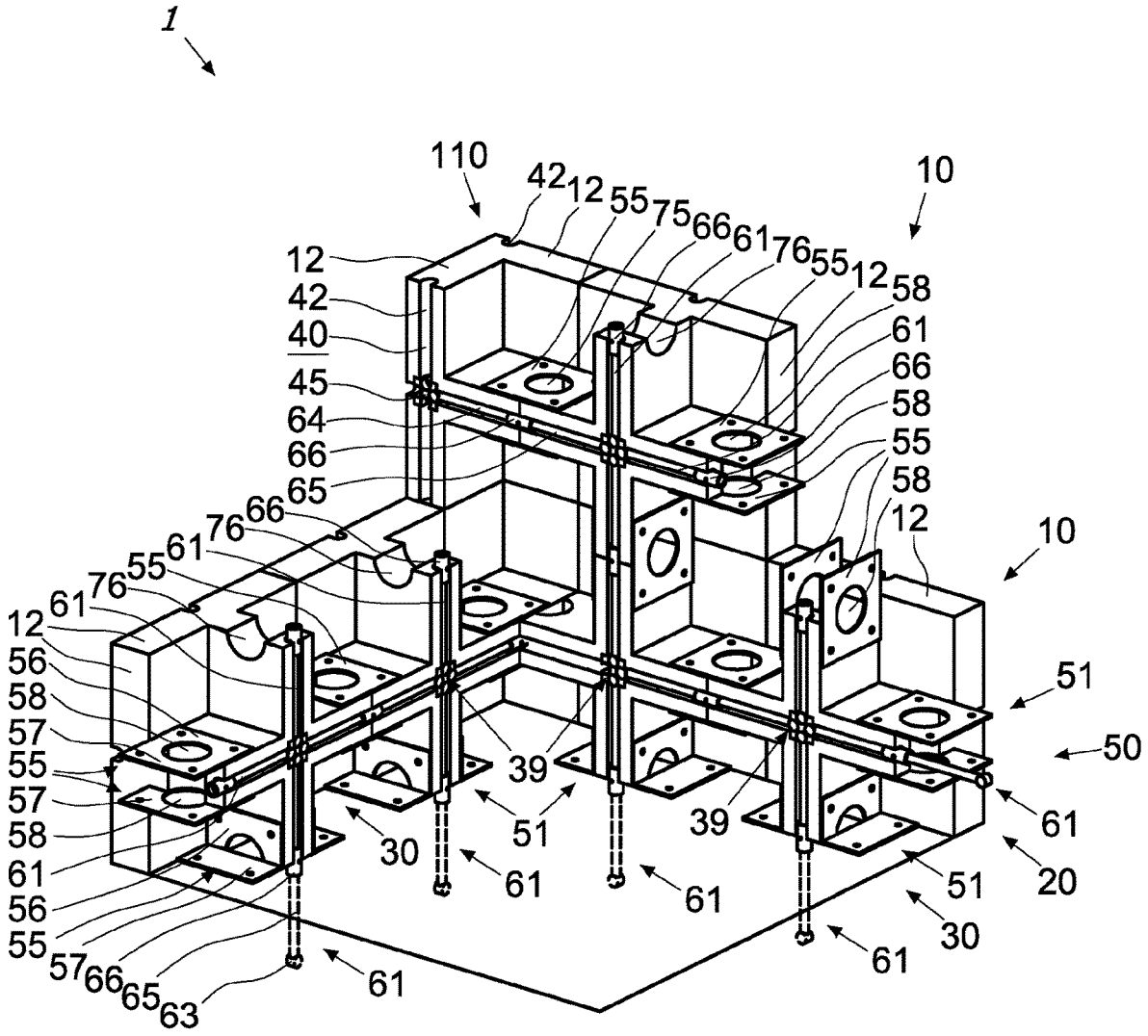
Figure 32:
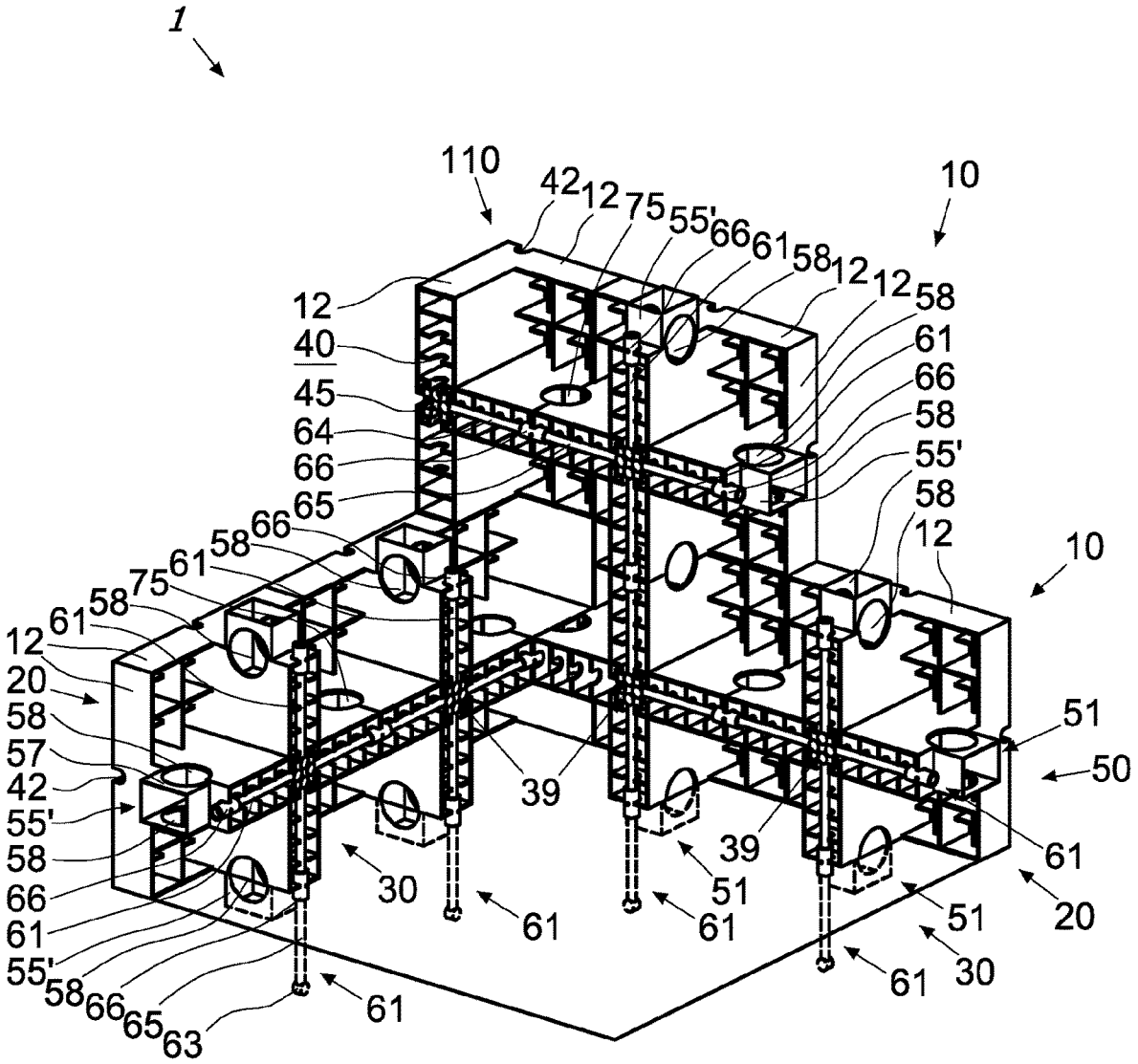
Figure 34A:
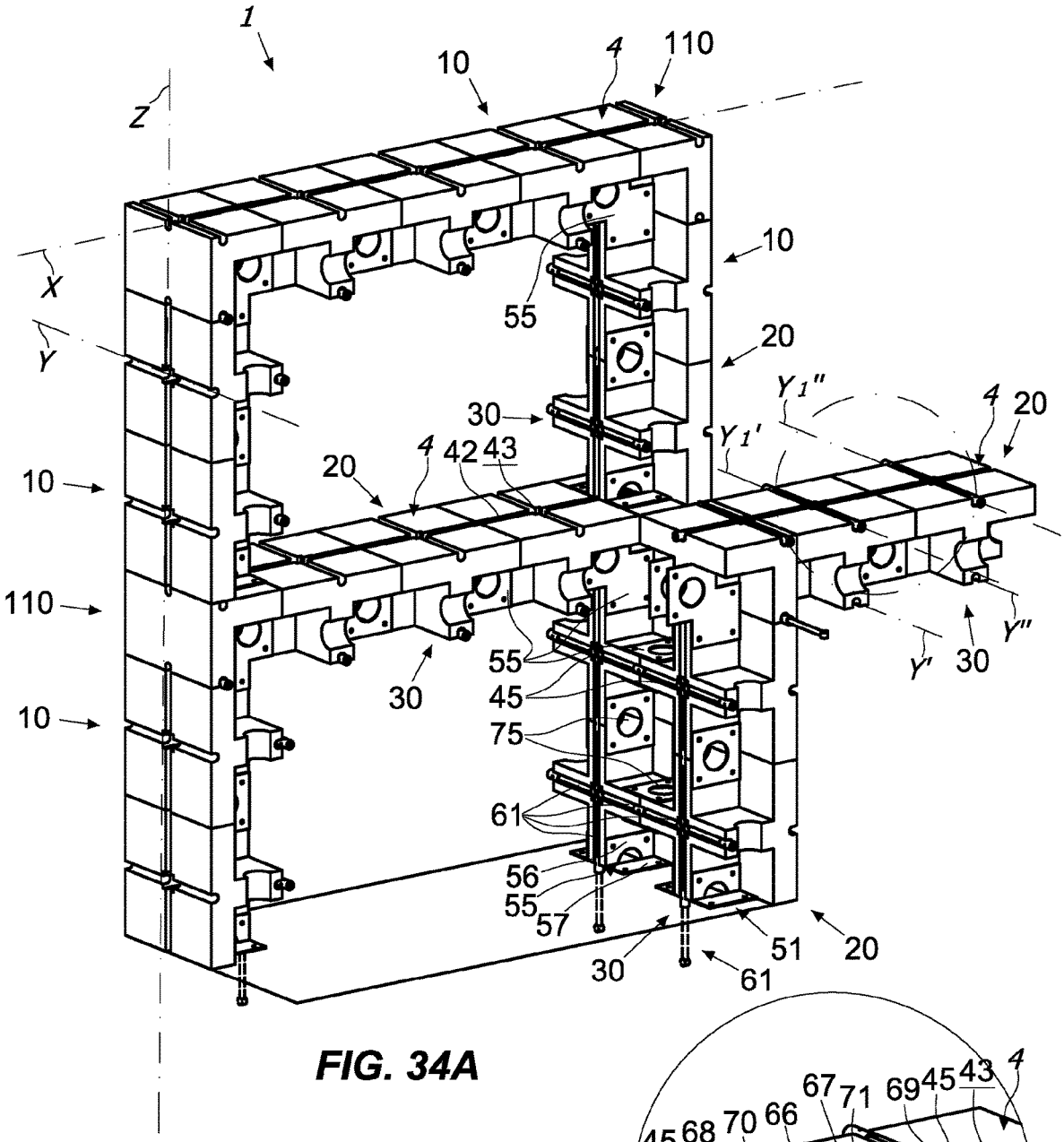
Figure 34B:
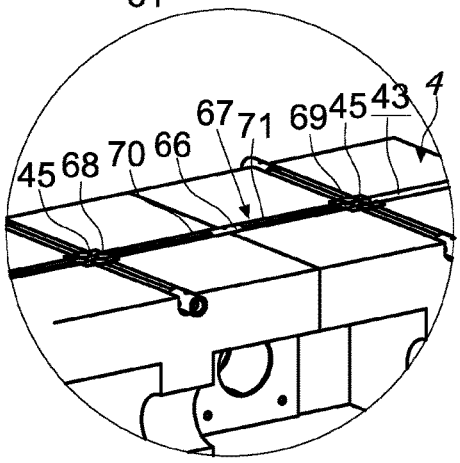
Figure 35A:
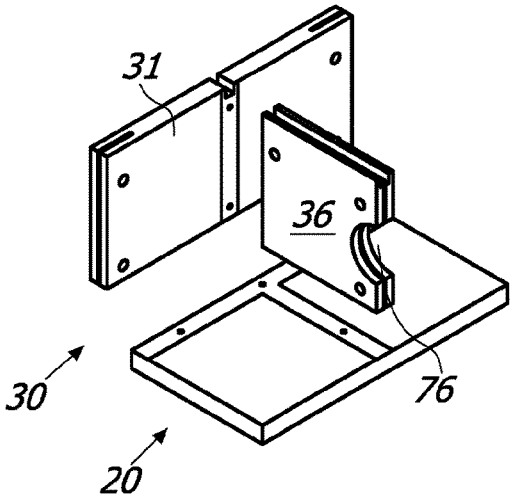
Figure 35B:
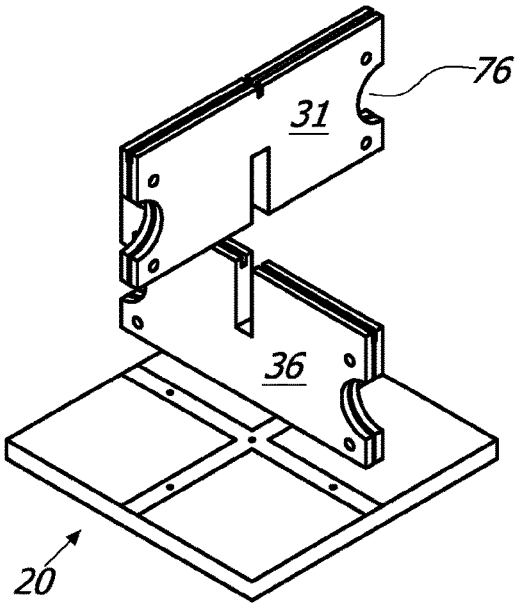
Figure 36:
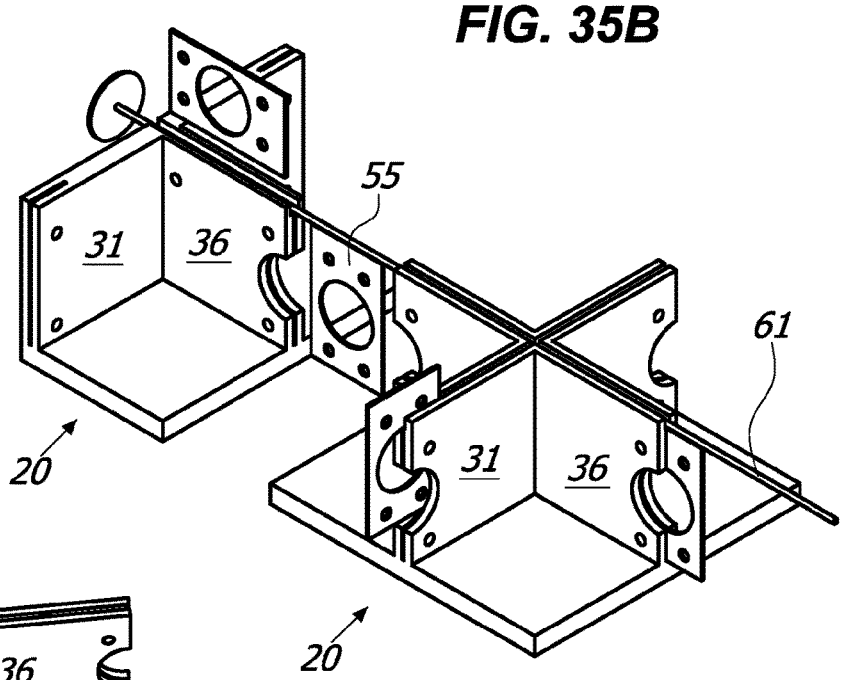
Figure 37:
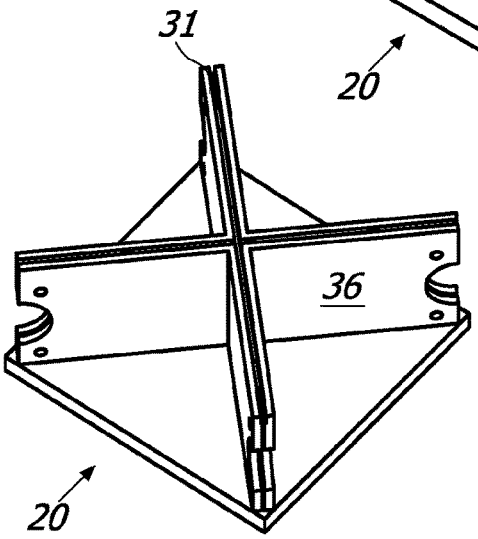
Figure 38:
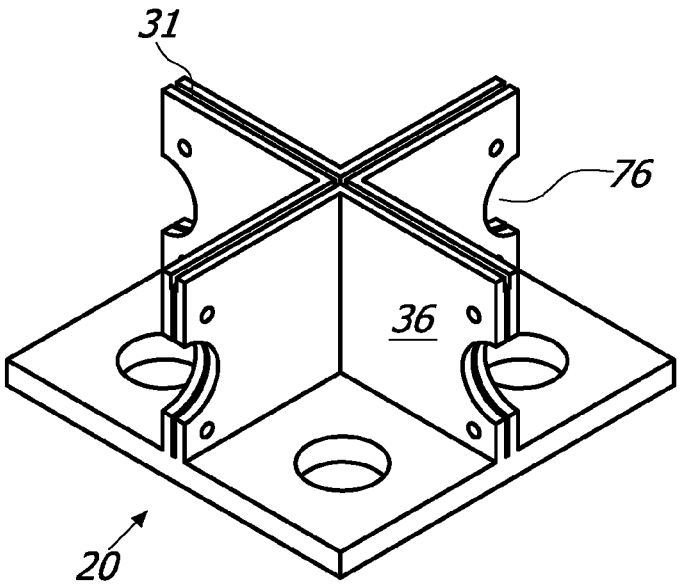
Figure 39:
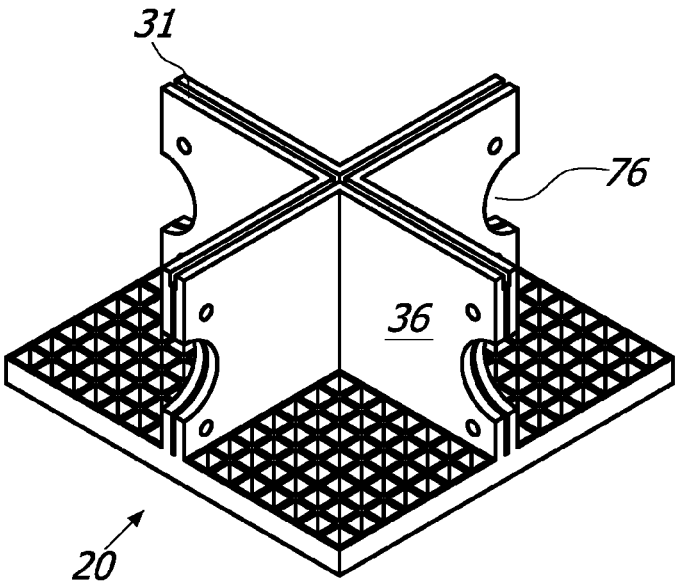

FIGS. from 9A to 17B are axonometric views of different embodiments of a modular element 10;

FIGS. from 18A to 27 are axonometric views of different embodiments of a beam or column 2;

FIGS. 28A and 28B are exploded axonometric views of some details of a beam 2, respectively, in a first and in a second embodiment;

FIGS. 29A and 29B are enlarged views of some details of a beam 2;

FIG. 30 is an axonometric view of an attic or a wall 3;

FIGS. from 31 to 34A are axonometric views of different embodiments of some details of a structure 1;

FIG. 34B is a enlarged view of some details of FIG. 34A;

FIGS. 35A and 35B are axonometric views of further embodiments of the modular element 10;

FIG. 36 is an axonometric view of another embodiment of the modular elements 10—removable anchoring means 50;

FIGS. 37, 38 and 39 are axonometric views of further embodiments of the modular element 10.

DETAILED DESCRIPTION OF SOME PREFERRED EMBODIMENTS

Figure 1:
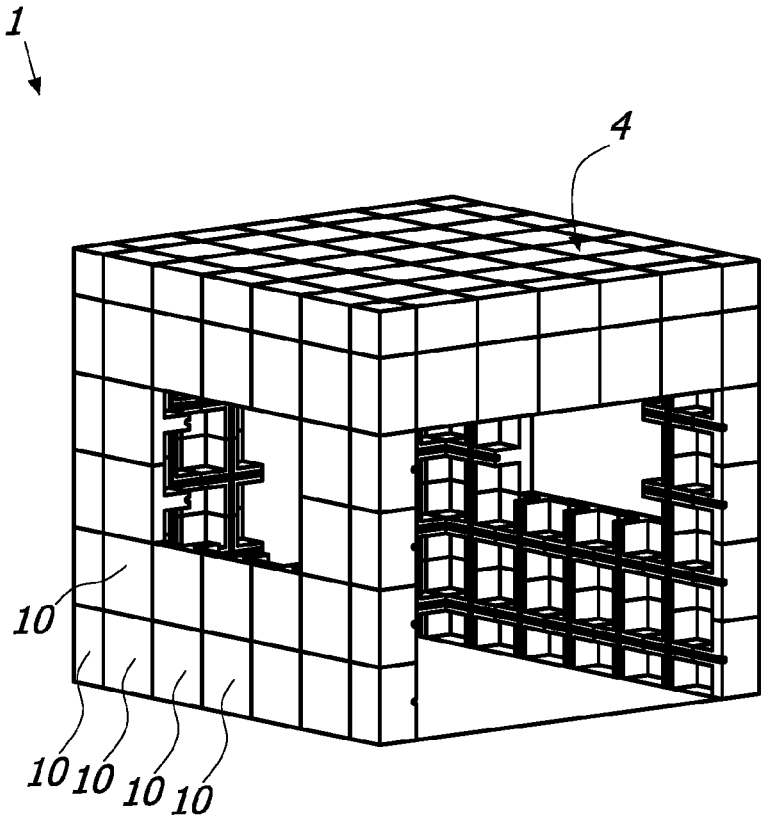
FIGS. 1 and 2 are axonometric views of a structure 1.

Referring to the mentioned drawings, it is described a modular system for the dry building of building structures 1, for example the one shown in FIG. 1. In particular, said structures 1 may have a substantially longitudinal development, as in the case of a beam 2, a column or similar structures (FIGS. 4A, 4B, 5A, 5B), or a substantially planar development, for example, walls 3, floors, balconies, roof pitches or similar structures (FIGS. 3A, 3B, 30, 33).

The structure 1 may be load-bearing or not.

As used herein, the term "structure" or derivatives thereof means a set of structural elements which, due to their nature, is designed to withstand compressive, tensile and shear stresses.

As used herein, the term "building structure" or derivatives thereof means a structure or a group of two or more structures designed for the construction of a building product, for both housing purpose (building structure) and non-housing purposes nonbuilding structure).

In case the structure 1 has a substantially planar development along the main development plane $\pi$, it may therefore be subject to loads both longitudinally and transversally to the plane $\pi$. For example, in case the structure 1 is a vertical bearing wall 3 of a house, it may be subject mainly to a compressive load which is parallel to the plane. On the other hand, in case the structure 1 is a floor 3 for a housing unit, it must be capable to withstand a load which is substantially orthogonal to the plane thereof.

Figure 2:
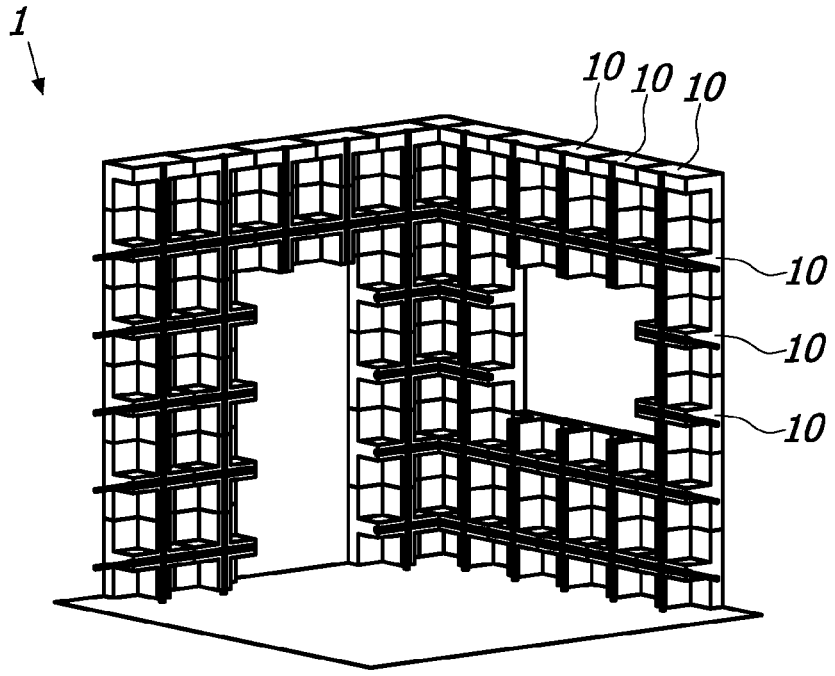
Figure 33:
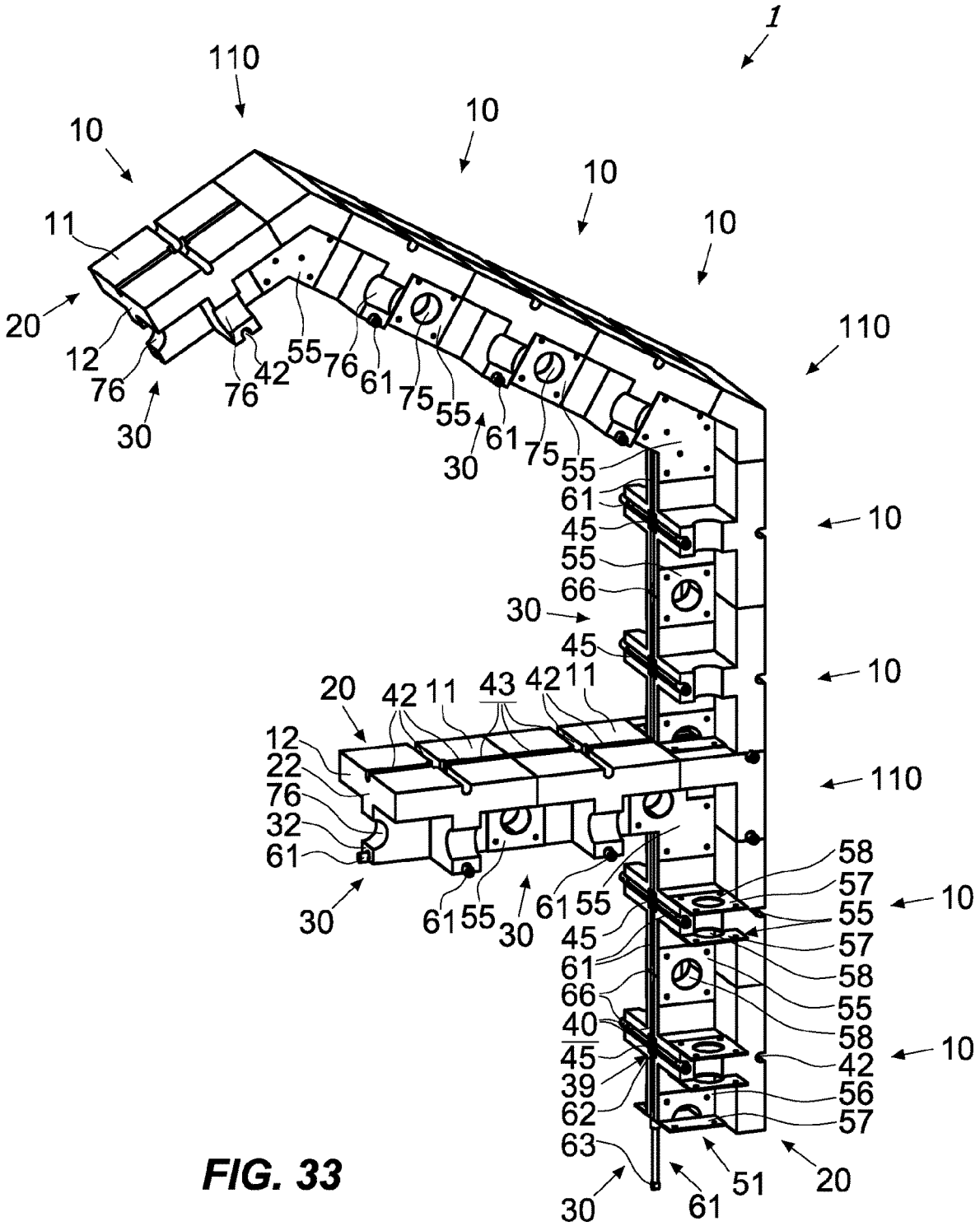

In particular, as shown for example in FIGS. 2, 33, 34A and better described hereunder, several planar and/or longitudinal structures 1 may be operatively coupled with each other so to obtain, for example, a truss, a garage, a balcony, a house, a fair stand or similar building structures.

As it is well-known, the action of a force, such as a load or a constraint, on the structure 1, generates on the structure itself 1, or on part of it, some compressive, tensile and shear stresses. Conveniently, the system may be configured to oppose such stresses.

Conveniently, the modular system may include a plurality of modular elements 10, 10', 10", which may be reciprocally coupled to obtain the building 1.

Said modular elements 10, 10', 10", may be manufactured of any material, preferably in plastic or metallic material or wood. In particular, the modular element 10 may be manufactured of recycled, recyclable or natural material or anyway a material which is at east partly of vegetal origin, so to have a low environmental impact.

The present invention may include several similar or identical parts and/or elements. If not otherwise specified, similar or identical parts and/or elements will be indicated with a single reference number, meaning that the described technical features are common to all similar or identical parts and/or elements.

The modular elements 10, 10', 10" may transmit any compressive stresses to each other by contact. Moreover, the modular system may include some mutual anchoring means 50 of the modular elements 10, 10', 10", which may withstand the tensile and shear stresses, as better described below.

Figure 27:
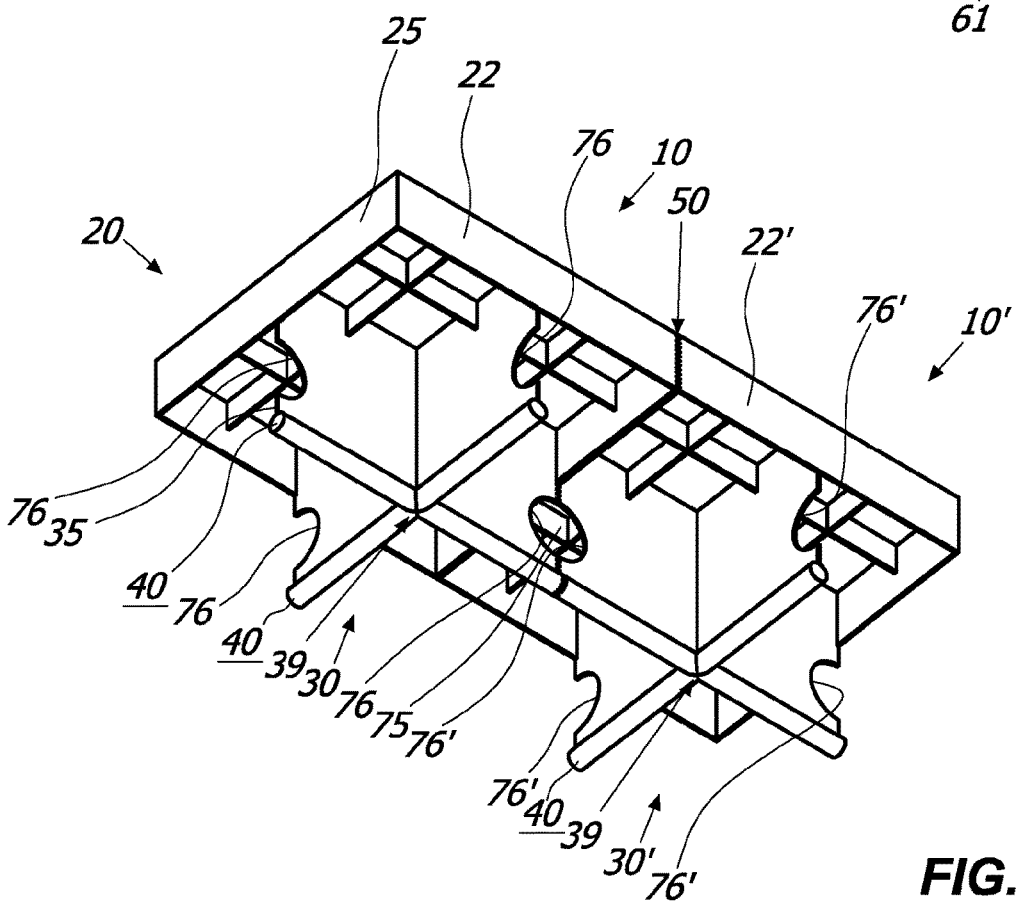

According to a particular embodiment shown in FIG. 27, the modular elements 10, 10', 10" may be firmly anchored, for example through welding. Conveniently, the latter may contrast any tensile and shear stresses.

On the other hand, the anchoring means 50 may be preferably of removable type.

In any case, in general each modular element 10 may comprise at least a plate-shaped element 20 and at least a functional zone 30 which is coupled or may be coupled to the plate-shaped element 20, whose functions will be better described hereunder.

Each modular element 10 may have at least one substantially planar wall 11, being part of the plate-shaped element 20, and one or several side faces 12, preferably substantially perpendicular to the planar wall 11, being part of both the plate-shaped element 20 and the functional zone 30.

For example, the planar wall 11 may define the upper wall of every modular element 10. However, it is understood that, according to the orientation of the modular element, said wall may define, for example, the lower wall, without departing from the scope of the present invention.

Once two or more modular elements have been coupled 10, 10', the respective e planar walls 11, 11' may lie substantially in the same plane and, in particular, may define a development plane $\pi_1$ substantially parallel and preferably corresponding to the main development plane $\pi$ of the structure 1, for example the exposed plane of a wall or an attic.

As shown in the appended figures and better explained below, the modular elements 10, 10', 10" may be coupled both longitudinally, for example along the X axis to form a beam 2, or along two different directions, for example along the X axis and a Y axis which may be perpendicular to the first to form a wall or an attic 3 which are substantially planar.

In this case, once the modular elements 10, 10' have been coupled, the plate-shaped elements 20, 20' may define a substantially continuous surface 4.

In particular, as shown for example in FIGS. from 9A to 17B and in FIG. 37, the plate-shaped element 20 may have a substantially planar upper side, which may define the planar wall 11 of the modular element 10.

On the other hand, the side faces 12 of the modular element 10 may include a first and edge 13 in correspondence of the substantially planar wall 11 and a second end edge 14 in front of the first.

More specifically, the plate-shaped element 20 may include the first end edge 13 while the functional zone 30 may include the second end edge 14 of the side faces 12.

According to another aspect of the invention, even the functional zone 30 of the modular element 10 may be intended to face a corresponding functional zone 30' of the adjacent modular element 10'.

In this way, the end edge 13 may cooperate with the corresponding end edge 13' of the adjacent modular element 10' to define the plane $\pi_1$, while the second end edges 14, 14' of the side faces 12 of the modular elements 10, 10' may reciprocally cooperate to define a second plane $\pi_2$ which is substantially parallel to the plane $\pi_1$ and opposed thereto.

In other words, following the mutual coupling of the modular elements 10 the two opposite planes $\pi_1$, $\pi_2$ may be obtained. In particular, as shown in the attached pictures and better explained hereinafter, the two planes $\pi_1$, $\pi_2$ may be located at the opposite ends of the modular elements 10.

Conveniently, in each modular element 10 the functional zone 30 may extend transversally to the plate-shaped element 20, preferably perpendicularly to it.

The transmission of the compressive stresses may occur through the mutual interaction between the corresponding side faces 12, 12' of two adjacent modular elements 10, 10'.

Preferably, each of the side faces 12 of the modular element 10 may be designed to come into contact, totally or partially, with the corresponding side faces 12' of the adjacent modular element 10'.

More specifically, the modular element 10 may have some portions 15 of the side faces 12 designed to come into contact with the corresponding portion 15' of the side face 12' of the adjacent modular element 10'. The contact portions 15 may be substantially planar and may be substantially orthogonal to the planes $\pi_1$, $\pi_2$.

According to the load direction, the contact portions 15 may be defined by a more or less large area of the side faces 12.

Figure 7:
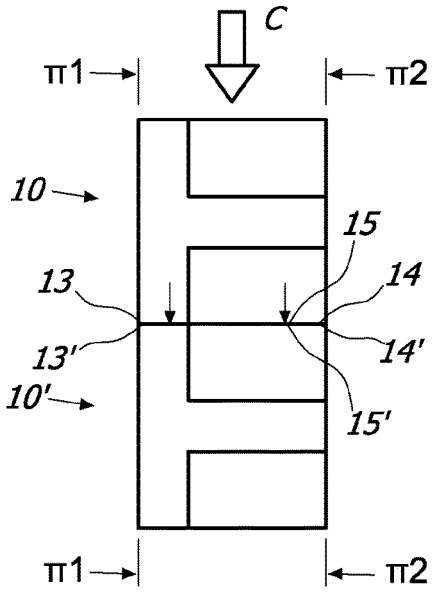
FIGS. 7, 8A and 8B are front schematic views of two modular elements 10, 10'.

For example, as schematically shown in FIG. 7, in case the load C is substantially parallel to the main development plane $\pi$ the compressive stresses may be transmitted substantially through contact portions 15 defined by the relevant side faces 12, 12' along their whole extension.

Figure 8A:
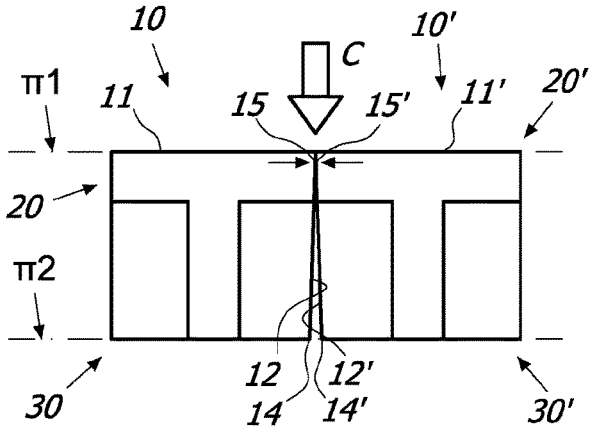
Figure 8B:
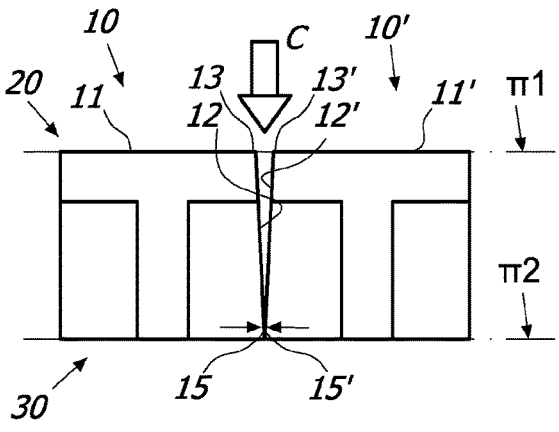
Figure 9A:
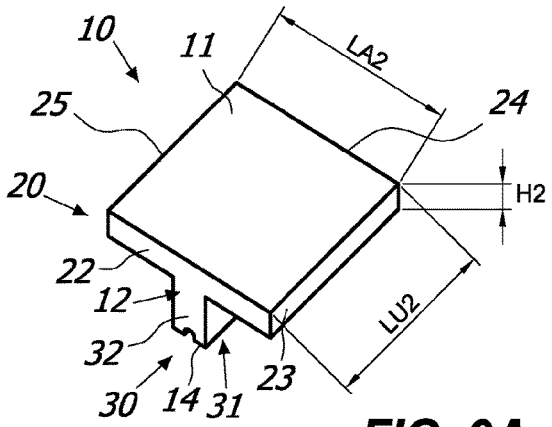
Figure 9B:
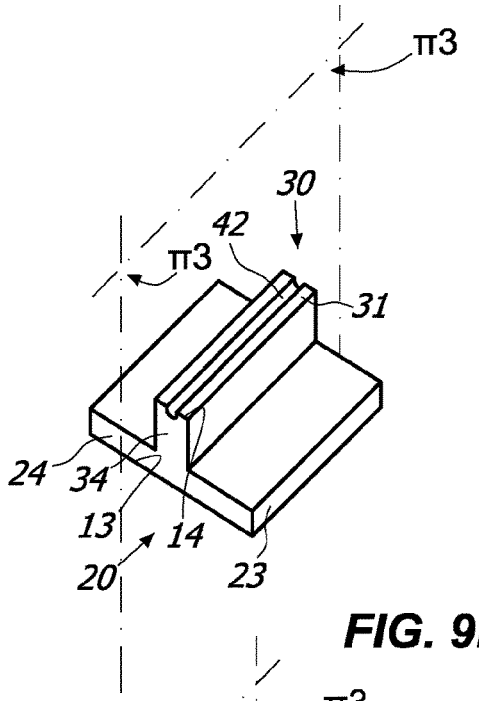

In case of loading force whose direction is transversal to the main development plane $\pi$, that is when the beam and/or the attic are subject to bending, the compressive stresses may be transmitted substantially along one of the two planes $\pi_1$, $\pi_2$ according to the direction of the load and/or type of constraint to which the structure is subject, as schematically shown in FIGS. 8A and 8B.

In other words, said stresses may be substantially transmitted by the plate-shaped element 20 that is through the edges 13, 13' of two adjacent modular elements 10, 10', or by the operating portion 30 and that is by the edges 14, 14' of two adjacent modular elements 10, 10'. As specified below, the edges which are opposite to the ones subject to compressive stresses are bound with each other through the anchoring means 50, which oppose the bending.

As shown in the appended figures, and in particular in FIGS. from 9A to 15B, the plate-shaped element 20 may be of a parallelepiped shape, preferably with a square base.

More specifically, the plate-shaped element 20 may have a length LU2 and a width LA2 higher than height H2. For example a length LU2 at least 3 times the height H2, preferably a length LU2 about 5 times the height H2.

For example, the plate-shaped element 20 may have a length LU2 and a width LA2 of about 50 cm or 60 cm, and a height H2 of about 10 cm.

Therefore, the plate-shaped element 20 may have four lateral portions 22, 23, 24, 25, which may include the edge 13 and have a substantially flat shape. In particular, as shown in FIGS. 28A and 28B, the side portion 24 of the plate-shaped element 20 may be designed to come into contact with the corresponding lateral portion 22' of the plate-shaped element 20' of the adjacent modular element 10' so to transfer its compressive stresses when these latter are transmitted substantially along the plane $\pi_1$. In other words, the lateral portions 22, 23, 24, 25 may define the contact portions 15.

More specifically, each modular element may include four side portions 22, 23, 24, 25 opposing each other two by two. For example, the portions 22 and 24 and the portions 23 and 25 may face each other. In case of a square-based plate-shaped element 20, the side portions 22, 23, 24, 25 may be all identical.

Figure 3A:
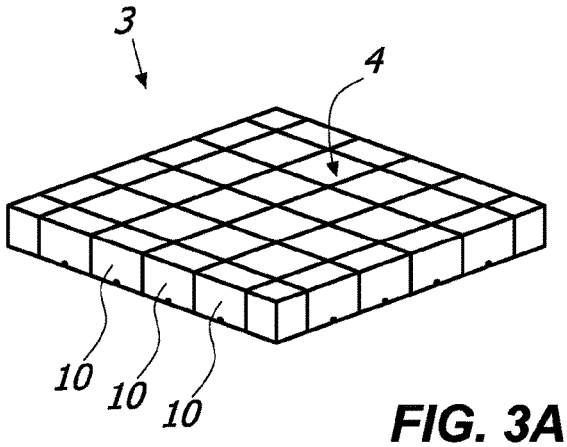
FIGS. 3A and 3B are axonometric views of, respectively, an attic and a wall 3.
Figure 3B:
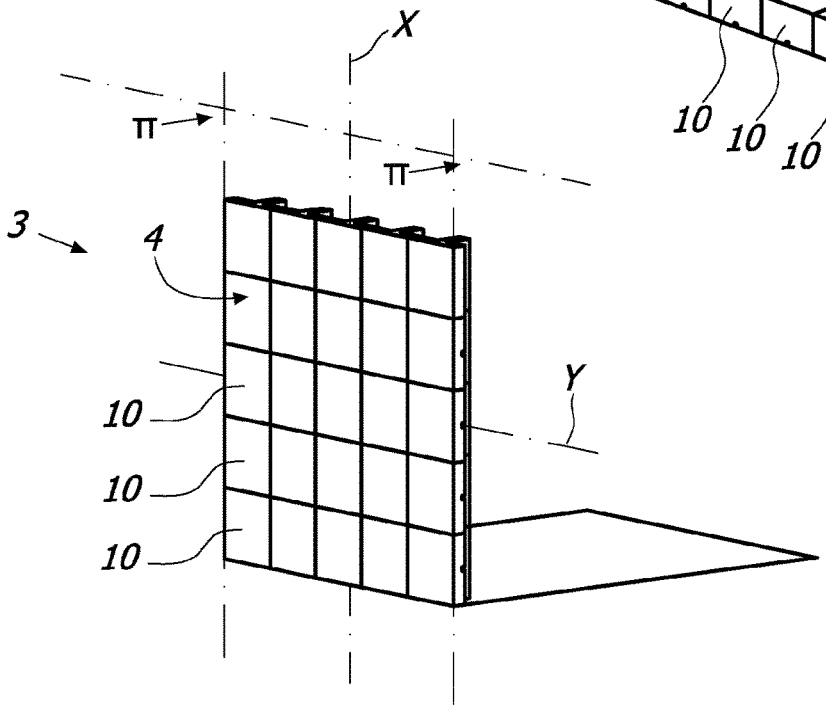
Figure 3C:
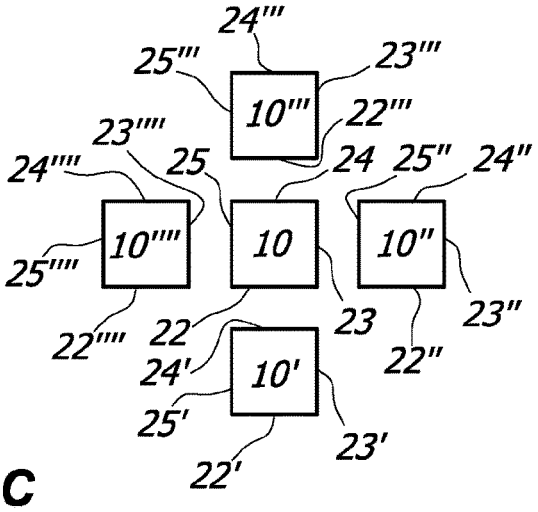
FIG. 3C is a schematic exploded view of some details of the wall 3.
Figure 4A:
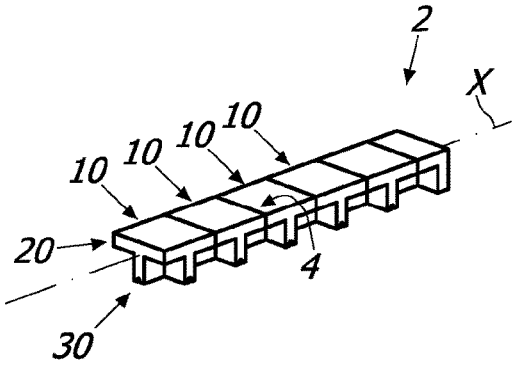
FIGS. 4A, 4B, 5A and 5B are axonometric views of a beam 2.
Figure 4B:
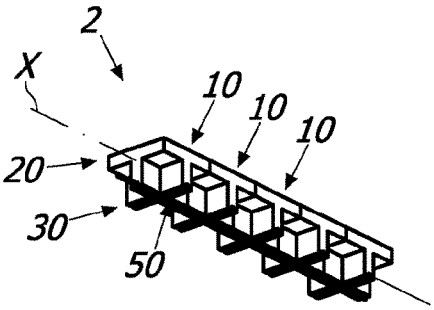
Figure 5A:
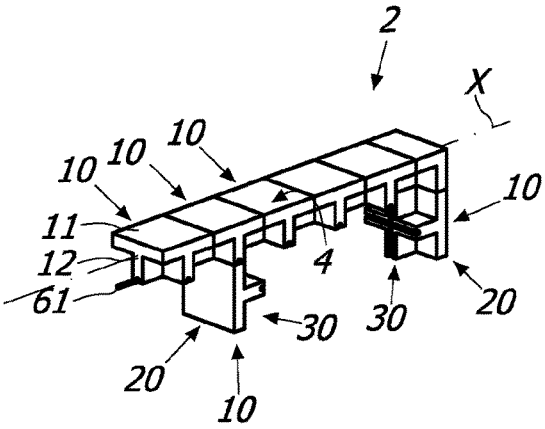
Figure 5B:
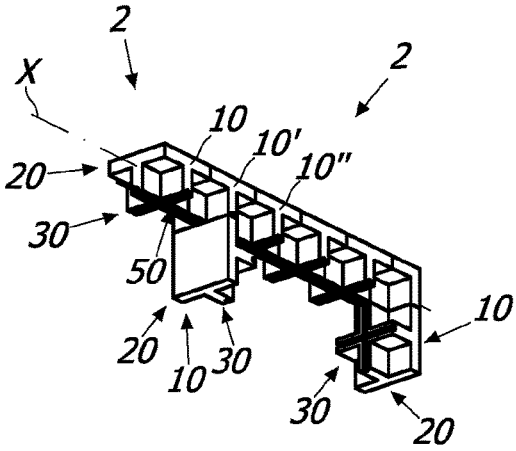

In particular, each lateral portion 22, 23, 24, 25 may come into contact with a corresponding portion of the adjacent modular element 10'. For example, each lateral portion 22, 23, 24, 25 may come into contact with the corresponding portions of four different adjacent modular elements 10', 10'', 10''', 10''''. More specifically, as schematically shown in FIG. 3C, the portions 22, 23, 24, 25 of the modular element may come into contact with the portions 24', 25'', 22''', 23'''' of the relevant adjacent modular elements 10', 10'', 10''', 10''''.

The functional zone 30 may include at least a planar plate 31 which extends from the plate-shaped element 20 along a plane $\pi_3$ substantially perpendicular to the plane $\pi_1$.

The planar plate 31 may have a length lower or substantially equal to the one of the plate-like element 20 and/or a width equal to one fifth of the length of the latter and/or a height equal to twice the width of the plate itself 31.

For example, the planar plate 31 may have a length LU3 of about 50 cm, a width LA3 of about 10 cm, and a height H3 of about 20 cm.

Thanks to said features, the modular element 10 may bee particularly compact. For example it may have a width LA1 and a length LU1 of about 50 cm, and a height H1 of about 30 cm.

According to a particular embodiment, the planar plate 31 may extend from the plate-shaped element 20 centrally, so that the modular element 10 has a substantially "T" shaped cross section.

The planar plate 31 may include a front portion 32 and a back portion 34, which may be substantially planar and lie in a plane which is substantially parallel to the plane of the lateral portions 22, 24 of the plate-shaped element 20. In other words, the front portion 32 and the back portion 34 may be substantially perpendicular to the plane $\pi_3$.

Conveniently, when one or several modular elements 10, 10', 10'' . . . are in mutual contact, even one of the portions 32, 34 of the modular element 10 and one of the corresponding portions 34', 32' of the adjacent modular element 10' may be in mutual contact.

More specifically, the front portion 32 and the back portion 34 may include the edges 14 so that they contribute to the transmission of the compressive stresses when they are transmitted substantially along the plane $\pi_2$. In other words, the portions 32, 34 of the plate 31 may take part in the transmission of the compressive stresses, so to define the contact portions 15.

According to a particular aspect of the invention, the front portions 32 of the plate 31 of the functional zone 30 and the side portions 22 of the plate-shaped element 20 may be placed so that the side portions 22 and the front ones 32 define a side face 12 substantially continuous of the modular element 10 and the side portions 24 and back ones 34 define the side face opposed to the first 12 of the modular element 10.

According to a different embodiment, the functional zone 30 may comprise another planar plate 36, defining a plane $\pi_4$, so as to form with the first a pair of planar plates 31, 36.

In particular, both the planar plates 31, 36 may have a length LU3 equal to length LU2 of the plate-shaped element 20, a width LA3 equal to one fifth of their length LU3 and a height H3 equal to twice their width.

In particular, as shown in the FIGS. from 11A to 14B and 16A and 16B, the plates 31, 36 may be placed crossed each other in order to form a cross shape, for example one substantially perpendicular to the other, both extending from the plate-shaped 20. In other words, the planes $\pi_3$ $\pi_4$ are substantially perpendicular each other.

Possibly, both planer plates 31, 36 may present the dimensions indicated above. According to a particular aspect of the invention, the height H2 of the plate-shaped element 20 and the width LA3 of the planar plates 31, 36 may vary depending on the material used for manufacturing the modular element 10.

Figure 12A:
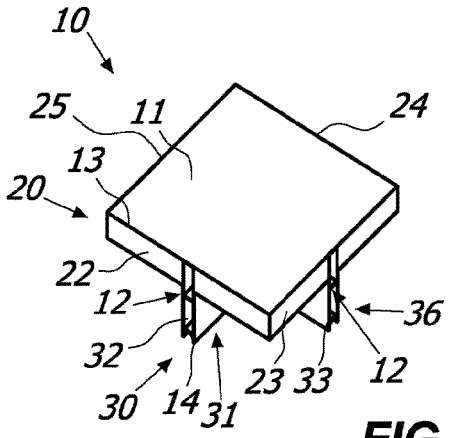
Figure 12B:
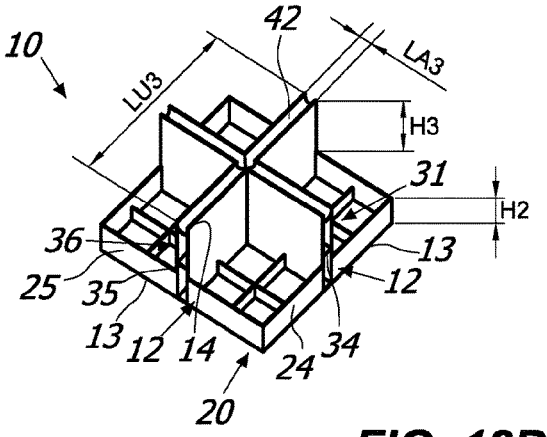
Figure 13A:
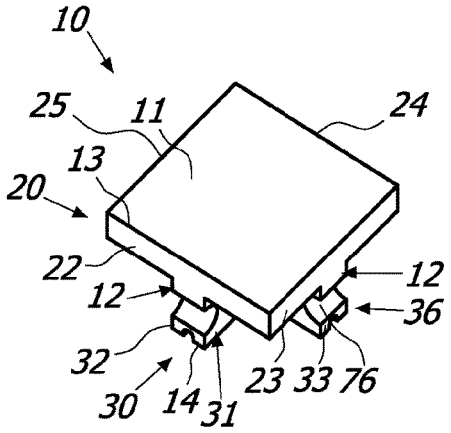
Figure 13B:
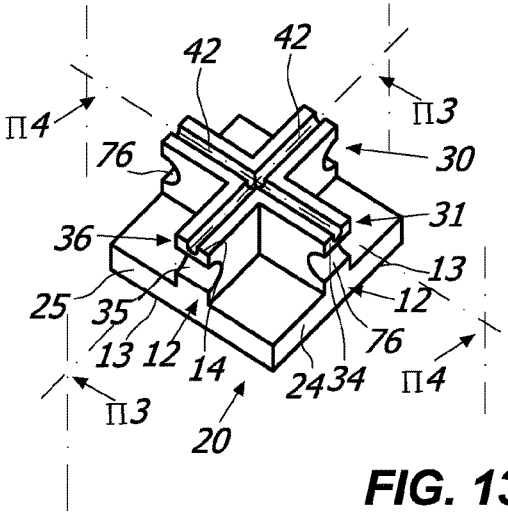

For example, in case the latter is realized in plastic, the height H2 of the first and the width LA3 of the second may be of about 10 cm, on the other hand, when the modular element 10 is manufactured in wood or metal metallic material, for example aluminum as shown in the FIGS. 12A and 12B, the height H2 and the width LA3 may have smaller dimensions, preferably of about 5 cm.

In particular, in such last case, the modular element 10 may have the same outer dimensions, for example a width LA1 and a length LU1 of about 50 cm and a height H1 of about 30 cm, but it may have different relationships with respect to those indicated above between the dimensions of the planar plates 31, 36 and the dimensions of the plate-shaped element 20.

More in detail, in case the element 10 is manufactured in metallic material, the width LA3 of the planar plates 31, 36 and the width LA1 of the element 10 itself, may have a relationship comprised between 0.1 and 0.2, while the height H3 may be about twice the height H2.

In a preferred, but not exclusive embodiment of the invention, in each modular element 10 the width LA2 may substantially be the same as the length LU2, which may also be substantially the same as the width LU3. Besides this, the height H2 may substantially be the same as the width LA3, and, as a consequence, the height H3 may substantially be equal to the half of the difference between the width LA2 and the width LA3.

According to an aspect of the invention, also the planar plate 36 may be placed centrally with respect to the plate-shaped element 20 and it may have respective side portions 33, 35 which may substantially be planar and placed in a plane substantially parallel to the plane $\pi_3$.

In other words, the pair of planar plates 31, 36 may intersect to form a central cross and may have four portions 32, 33, 34, 35 aimed at interacting with one respective lateral portion of the adjacent modular elements 10', 10'', 10''', 10''''.

The modular element 10 may then have a "T" section, both on the side and in the front. In such a way, the modular element 10 may be coupled, indifferently, with another modular element 10 along a longitudinal direction defined by the axis X or along a transverse direction, perpendicular to the longitudinal direction, defined by axis Y.

This highly simplifies the building of the structures 1, since there is no preferred direction for the building thereof. At the same time, there is complete freedom in the design and manufacturing of any structure configuration.

Figure 16A:
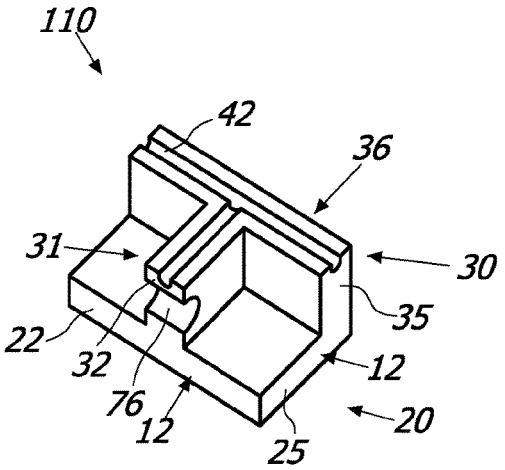
Figure 16B:
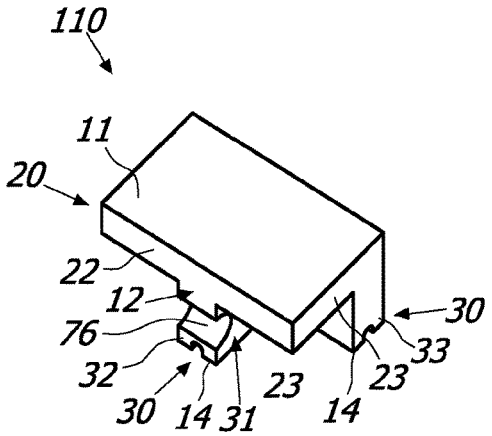

According to a different embodiment, shown in the FIGS. 16A and 16B, the modular element 10 may have a substantially "L" shape so as to define an edge element 110.

In particular, a planar plate 36 may be longer than the other plate 31 so that the portions 33 and 35 of the functional zone 30 cooperate with the lateral portions 23, 25 of the plate-shaped element 20 in order to define two side faces 12 of substantially "L" shape, the portion 34 of the functional zone 30 and the side portion 24 of the plate-shaped element 20 cooperate to define a side face 12 substantially planar having width and height equal to the width and height of the modular element 10, and the portion 32 of the functional zone 30 and the side portion 22 of the plate-shaped element 20 cooperate to define a side face 12 of substantially "T" shape.

Possibly, as for example shown in the FIG. 33, the two side faces 12 of substantially "L" shape may define an angle different from 90°, more in general an angle comprised between 1° and 180°, preferably comprised between 100° and 150°. In particular, the edge element 110 may be used to couple the pitches of a roof each other and/or a pitch of a roof with a wall.

In other words, the edge elements 110 may have a different angle depending on the requirements.

Figure 17A:
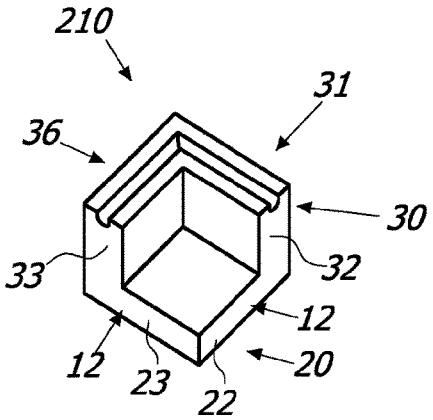
Figure 17B:
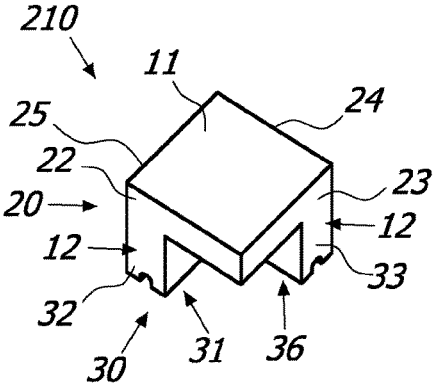
Figure 18A:
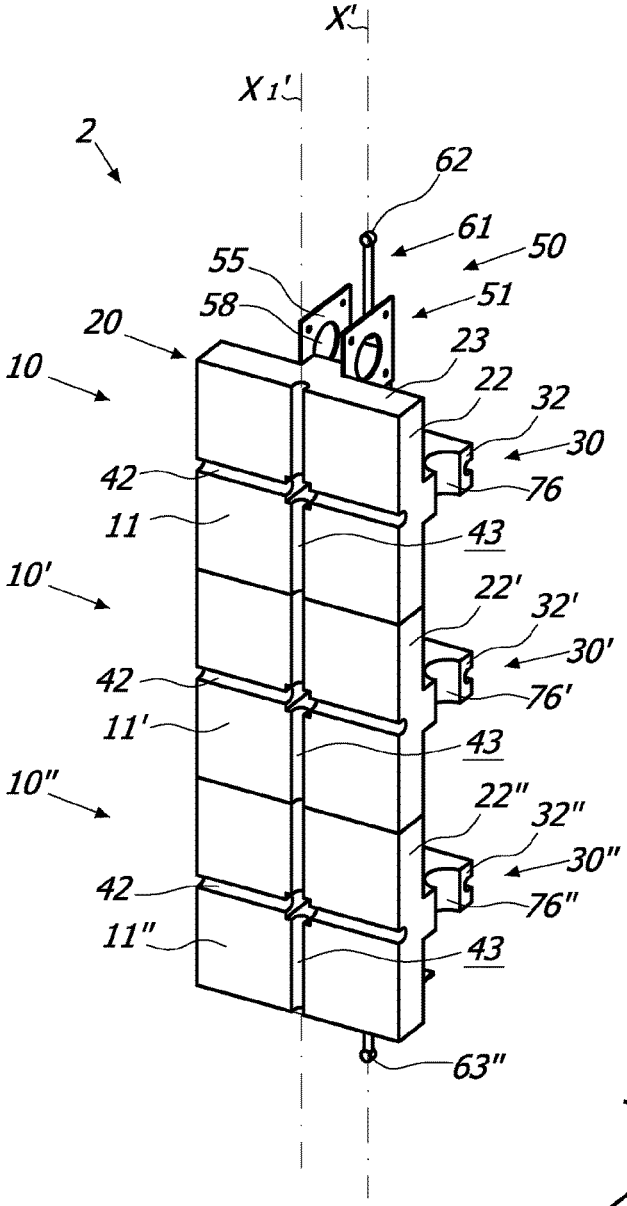
Figure 18B:
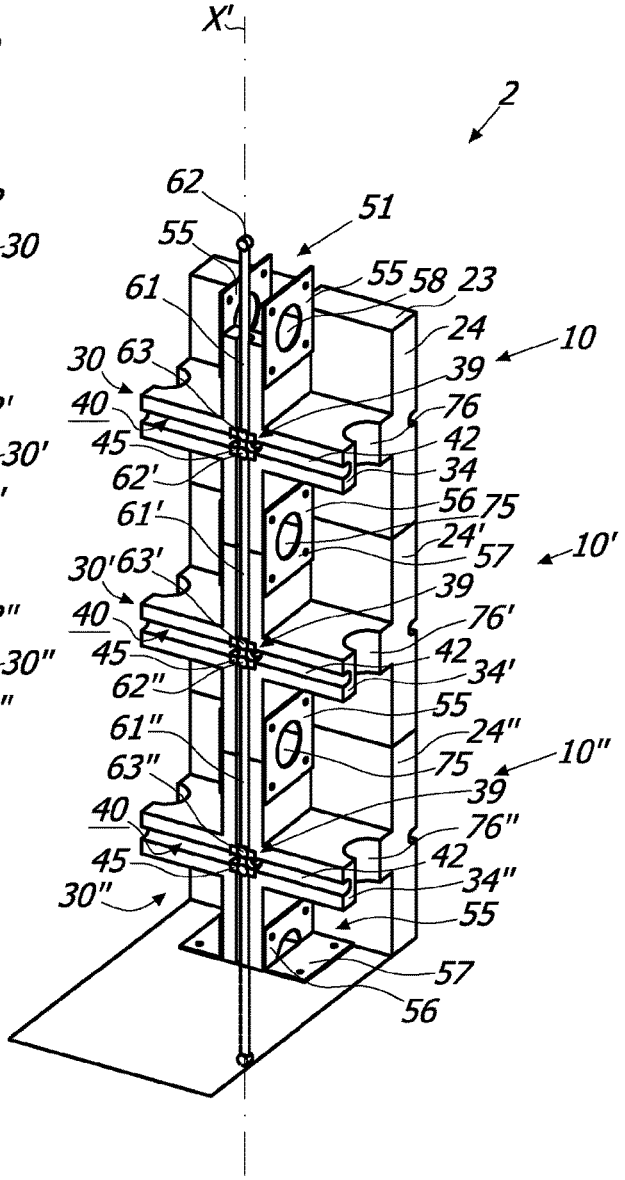
Figure 19A:
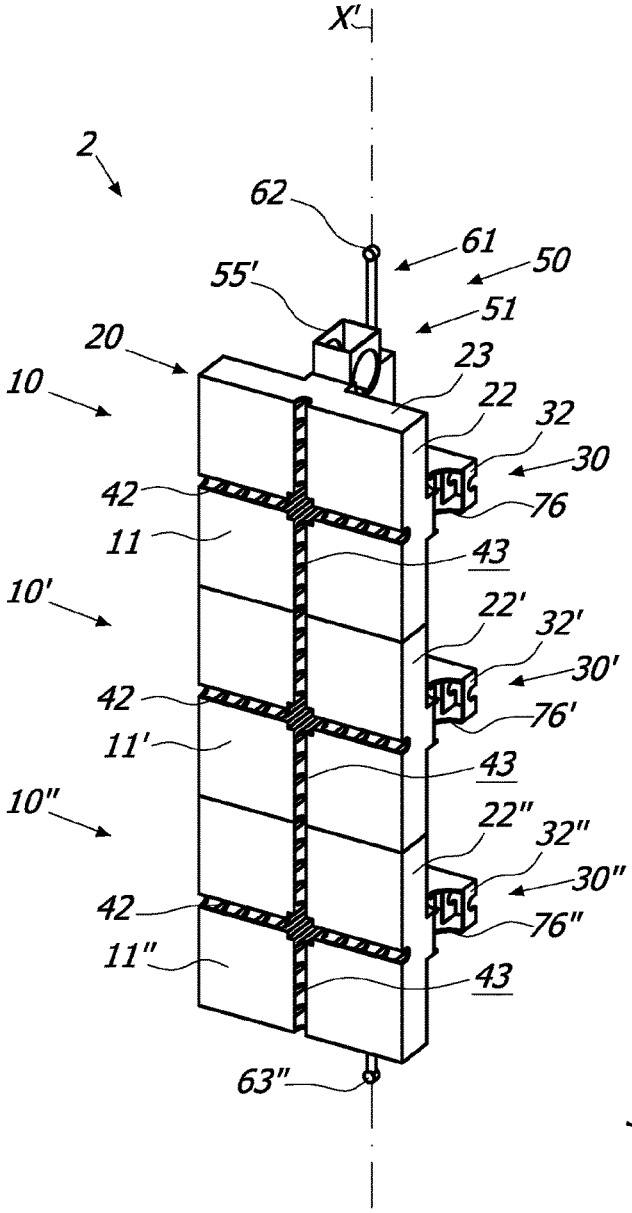
Figure 19B:
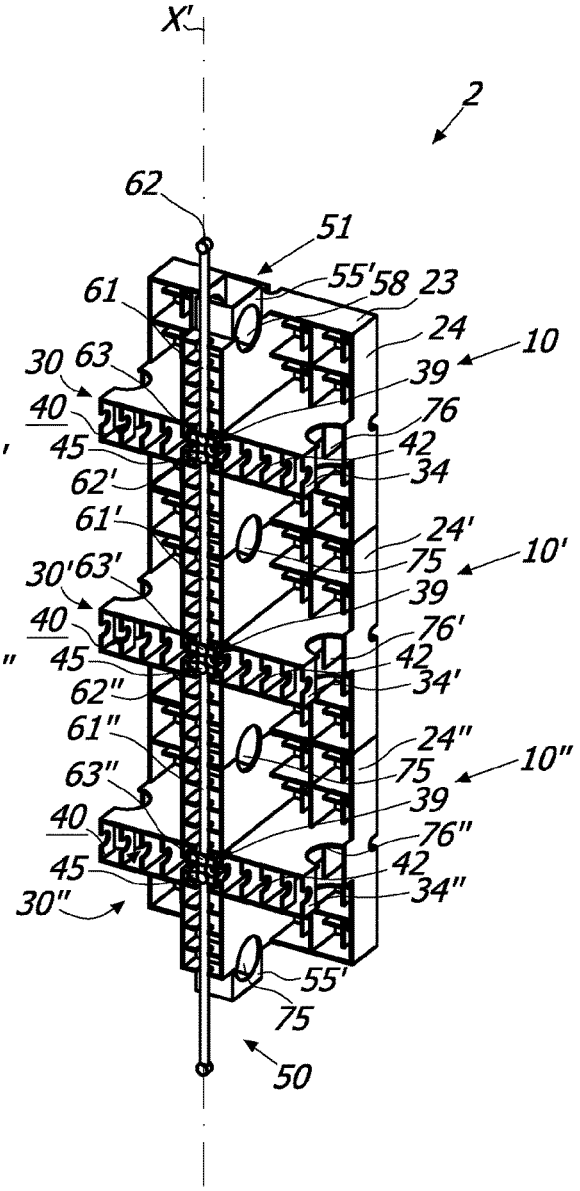
Figure 20A:
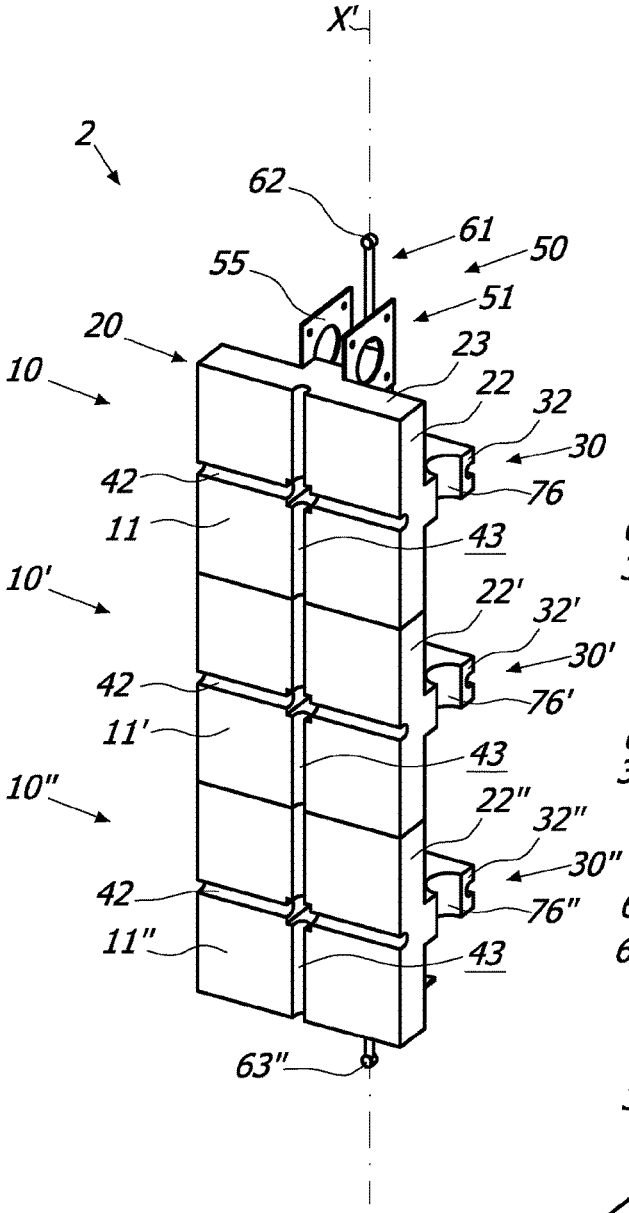
Figure 20B:
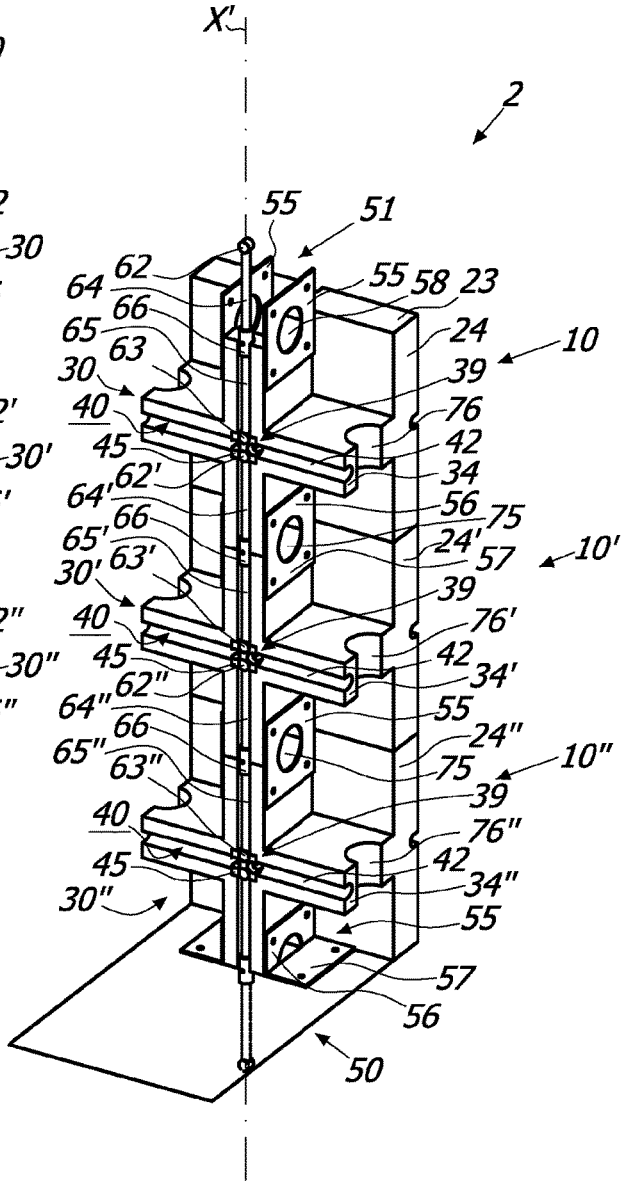
Figure 21A:
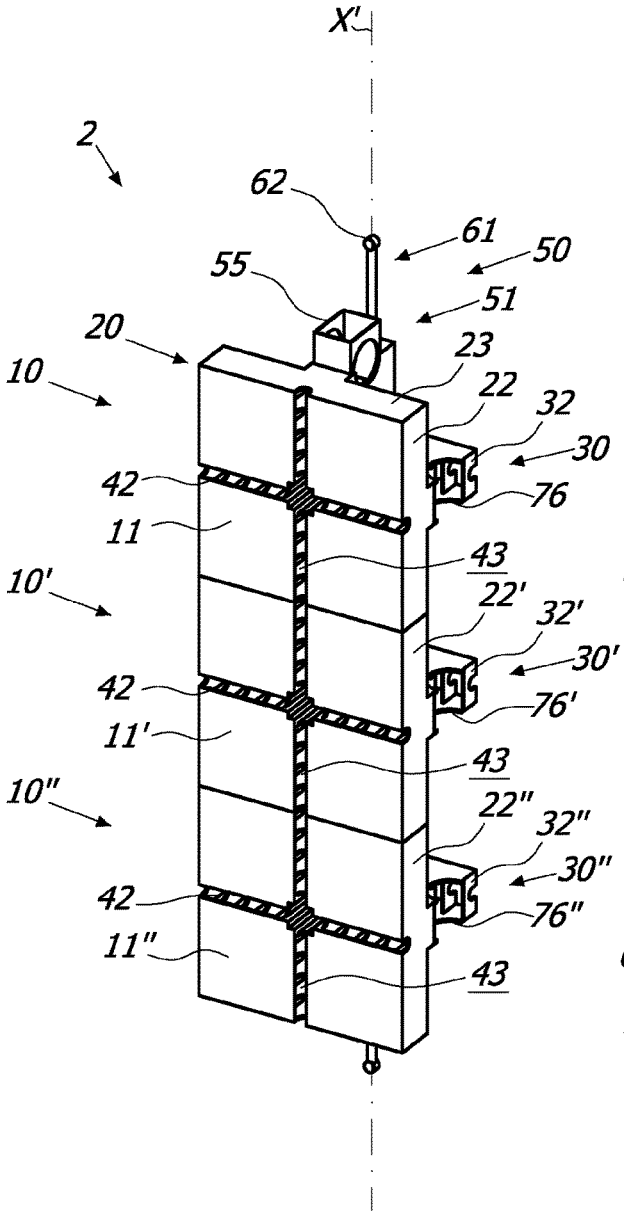
Figure 21B:
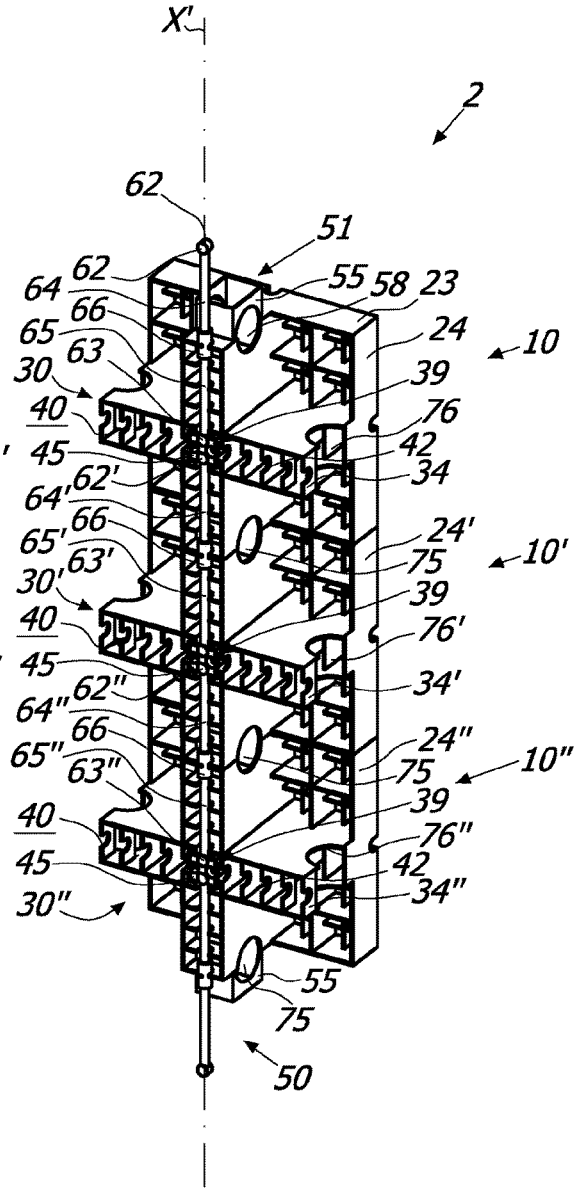

According to a different embodiment, shown in the FIGS. 17A and 17B, the modular element 10 may substantially be an angular element 210.

In particular, the planar plates 31, 36 may be placed substantially perpendicular to each other, both extending from the plate-shaped element 20. More in particular, the same planar plates 31, 36 may be placed laterally with respect to the plate-shaped element 20 so that the portions 34, 35, respectively, of the plates 31, 36 of the functional zone 30 cooperate with the side portions 24, 25 of the plate-shaped element 20 in order to define two side faces 12 consecutive to the modular element 10 of substantially square shape.

On the other hand, the portions 32, 33, respectively, of the plate 31, 36 of the functional zone 30 may cooperate with the side portions 22, 23 of the plate-shaped element 20 in order to define two side faces 12 consecutive to the modular element 10 of substantially "L" shape.

Figure 10A:
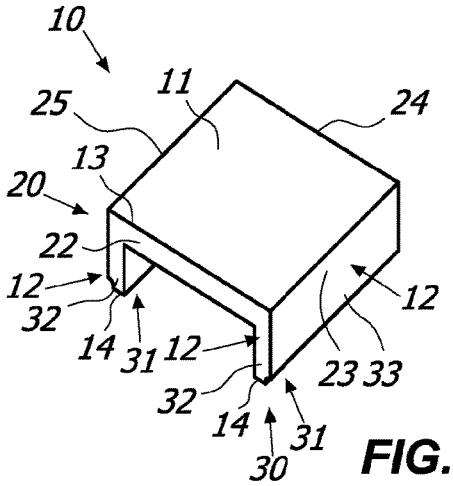
Figure 10B:
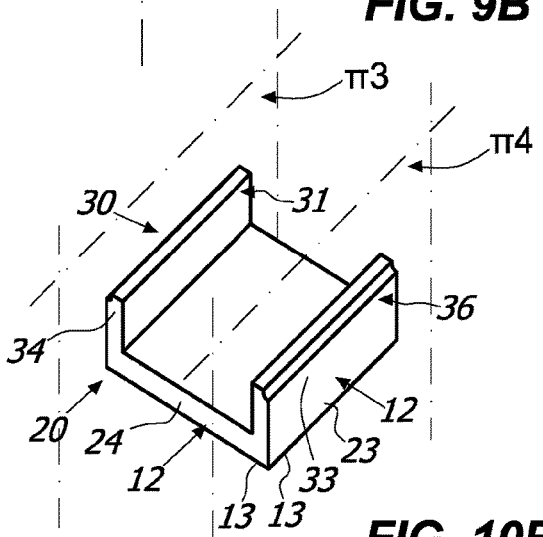
Figure 11A:
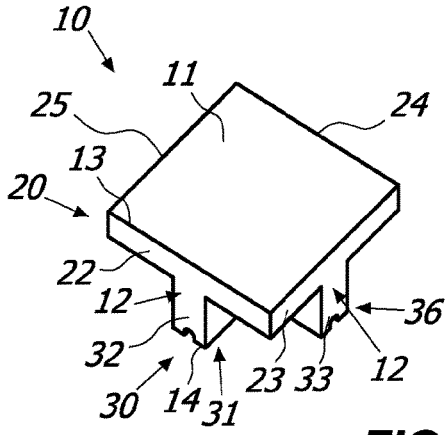
Figure 11B:
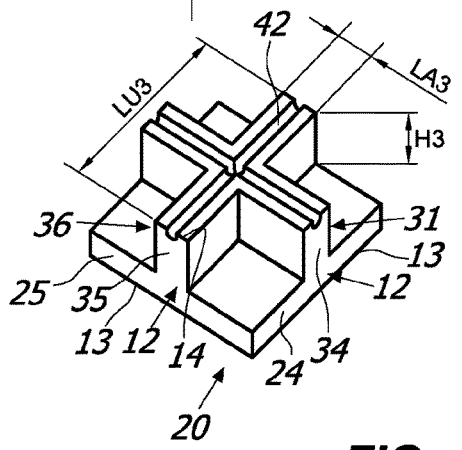

According to a different embodiment, shown in FIGS. 10A and 10B, the planar plates 31, 36 may be placed laterally with respect to the plate-shaped element 20, one facing the other so as to be substantially parallel. More in detail, in said embodiment, the two planes $\pi_3$ $\pi_4$ are substantially parallel to each other. For example, considering a transverse portion of the modular element 10, the latter may have a shape of a substantially reversed "U".

Said planar plates 31 may have each a front portion 32 which may define a side face 12 of the modular element 10, a back portion 34 which may define another of the side faces 12 of the same modular element 10. In particular, the portions 32, 34 may contribute to the transmission of the compressive stresses defining in this way the contact portions 15.

Possibly, the planar plates 31, 36 may be placed so that each of them have a side surface substantially flat 33, 35 placed parallelly to the plane $\pi_3$. In particular, the side portions 33, 35 may then define two opposite faces 12 of the modular element 10.

Due to the geometrical features of the modular elements 10 described above, the same are easily stackable, for example in a stock area or during the transportation.

Figure 6:
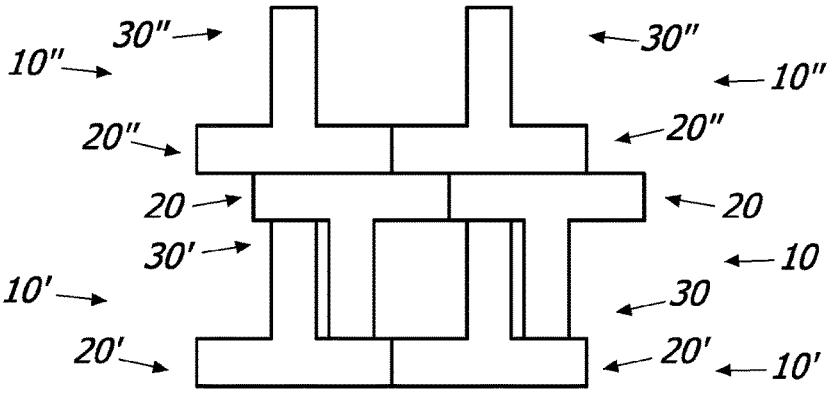
FIG. 6 is a schematic of a plurality of modular elements 10.

For example, as shown in FIG. 6, the modular elements 10 may be placed in rows so that the plate-shaped element 20 of each of them is in contact with the functional zone 30' of the element of the lower row and with the plate-shaped element 20" of the modular elements 10" of the upper row.

It is understood that the modular elements 10 may be placed in different ways depending on the requirements, safeguarding the space and improving the stacking thereof.

Figure 15A:
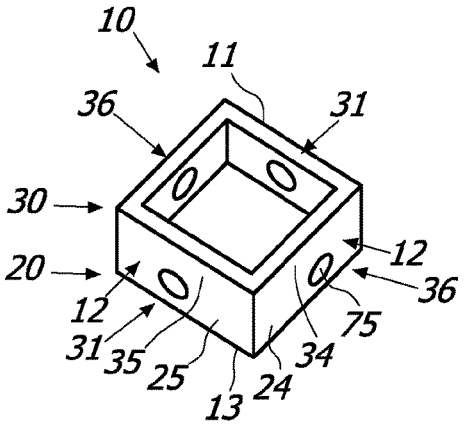
Figure 15B:
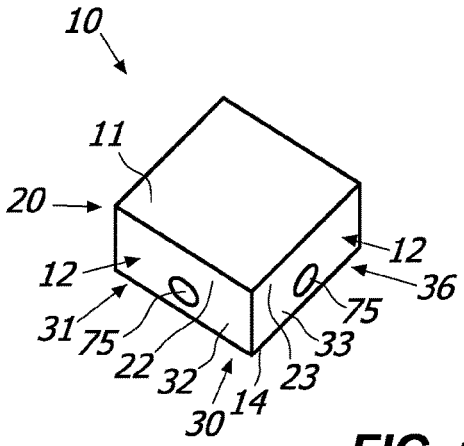

According to a different embodiment shown in FIGS. 15A and 15B, the modular element 10 may comprise two pairs of planar plates 31, 36 facing each other. In particular, each of the planar plates 31, 36 may have an outer surface 32, 33, 34, 35 substantially parallel to the side portions 22, 23, 24, 25. In particular, the first and the second may define four faces 12 of the modular element 10.

More in general, in all the embodiments, the portions and/or surfaces 32, 33, 34, 35 of the functional zone 30 and the corresponding side portions 22, 23, 24, 25 of the plate-shaped element 20 may define the four faces 12 of the modular element 10.

Depending on the transmission plane of the compressive stresses on the modular element 10, one or more of such portions 32, 33, 34, 35, 22, 23, 24, 25, may contribute to the transmission of the compressive stresses in order to define the contact portions 15.

In a preferred but not exclusive embodiment, shown for example in the FIGS. 35A and 35B, the plate-shaped element 20 and the functional zone 30 may be removably coupable each other, for example through screw and screw nut means or wedge means or insertion means of male/female type, not represented in the figures since already known. This highly facilitates the transportation and the handling.

In particular, in case of functional zone defined by the planar plates 31, 36, also these latter may be removably coupable each other and to the plate-shaped element 20.

As indicated above, the structure 1 may be subject to shear and tensile stresses, in addition to the already cited compression stresses.

The anchoring means 50 may be mounted on the modular elements 10 once they have been preemptively coupled, so as to form the structure 1.

Besides this, as better explained hereinafter, the anchoring means 50 and the modular elements 10 may be reciprocally configured so that the same anchoring means 50 once mounted, may be all accessible for their removal, without the necessity of decoupling the modular elements 10, 10', 10" each other.

In such way, the operator may remove from the structure 1 one or more central modular elements 10 without the need to act on the peripheral modular elements.

Thanks to said feature, the maintenance and/or replacement operations of the modular elements 10, for example because one or more of them break or is damaged, may be faster and cheaper.

Besides this, it is possible to modify the structure 1 without fully dismounting it. For example, it is possible to modify the structure 1 to realize, close or modify a window, a door or a front door.

In particular, the anchoring means 50 may include at least one elongated anchoring member 61 susceptible to join two modular elements preferably adjacent 10, 10' so as to contrast the tensile stresses.

The elongated anchoring members 61 may be configured so as to join two different modular elements 10, 10' in proximity to the functional zone 30, in particular of the central zone 39 thereof.

According to an aspect of the invention, as shown in particular in the FIGS. from 18A to 28B, said elongated anchoring members 61 may preferably join two by two modular elements 10, 10' adjacent each other.

The anchoring members 61 may have an elongated shape defining an axis X' substantially parallel to the longitudinal axis X. For example, in case the structure 1 is a beam 2, the axis X' may coincide with the longitudinal axis X.

In case the load-bearing structure 1 develops substantially planar 3, the anchoring means 50 may comprise a plurality of anchoring elongated members 61 each defining a respective axis X.

Said elongated anchoring members 61 may be, for example, rope-shaped rods or chains, and they may be manufactured in metallic material.

According to another aspect of the invention, as shown in the FIGS. from 30 to 34B, the anchoring means 61 may act along axis X', X", X" substantially parallel each other and/or along axis Y', Y", Y'" substantially parallel each other.

Conveniently, the axis X', X", X" and the axis Y', Y", Y'" may be transverse each other and preferably substantially perpendicular, so as to allow the structure 1 to be highly rigid.

According to an aspect of the invention, the axis X', X", X" may define a plane $\pi_5$ while the axis Y', Y", Y'" may define a plane $\pi_6$. The planes $\pi_5$, $\pi_6$ may be substantially parallel or coincident each other.

In particular, said planes $\pi_5$, $\pi_6$ may be substantially parallel to the plane $\pi_1$. Possibly, the same $\pi_5$, $\pi_6$ may substantially coincide with the plane $\pi_2$. In other words, the anchoring members 61 may form a net substantially placed along the plane $\pi_2$.

This allows the structure 1 to highly resist the bending stresses, since the plane $\pi_1$, along which the compressive stresses develop, is opposed and spaced to the plane $\pi_2$ along which the tensile stresses develop.

What above is particularly advantageous with respect to the known systems, in which the rods are placed in the central part of the modular element. In order to couple two or more modular elements 10, 10', 10" . . . each anchoring member 61 may have respective ends 62, 63 which may be anchored in correspondence with the functional zones 30, 30' of two different modular elements 10, 10', preferably in correspondence with the central part 39 of the functional zones 30.

Each anchoring member 61 may have any length, such as to couple two or more modular elements 10, 10', 10".

Figure 26:
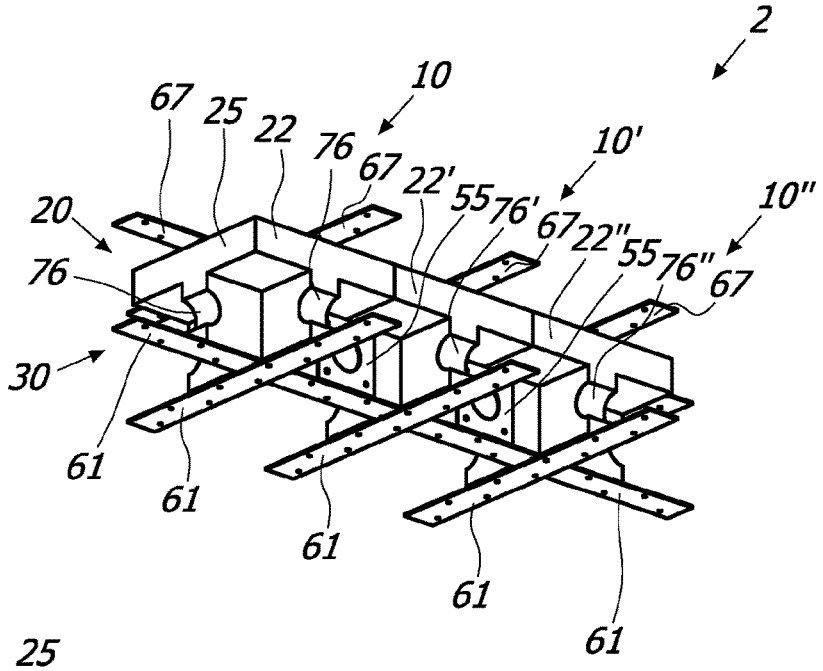

In an embodiment, shown for example in FIG. 26, the anchoring members 61 may have such length so as to couple a plurality of modular elements 10, 10', 10", for example through spikes, forks and any fastening element.

Preferably, as shown in the FIGS. from 18A to 24B, each anchoring element 61 may have such length so as to couple two adjacent modular elements 10, 10'.

Conveniently, in some embodiments of the invention of the modular element 10 may comprise at least one seat 40 to house at least one portion of at least one of the anchoring members 61.

Advantageously, the seats 40 may be configured and/or positioned so that the axis X' and/or the axis Y' are arranged respectively at planes $\pi_5$, $\pi_6$.

Preferably, each seat 40 may comprise at least one housing 41 for the end 62, 63 of the elongated anchoring member 61. In particular, the seat 40 may be placed in the central part 39 of the functional zone 30 of the modular element 10.

More in particular, each of the central parts 39 of the functional zones 30 of the modular elements 10 may comprise a plurality of seats 40, for example 4 seats forming a cross, suitable for housing the respective end 62, 63 of a corresponding plurality of anchoring members 61.

For example, in case of functional zone 30 with cross configuration, each of the planar plates 31, 36 may include a couple of seats 40 which may be symmetrical with respect to the central part 39.

In this way, each modular element 10 may be connected in an easy and fast way with a corresponding plurality of adjacent modular elements 10', 10", 10'", 10"".

Conveniently, the seats 40 may be at least partially accessible in correspondence with the plane $\pi_2$ to allow the insertion/the removal of the anchoring members 61 therein/therefrom without decoupling the modular elements 10, 10', 10" each other.

Thanks to such feature, the anchoring means 61 may be of removable type. In this way, the replacement and/or maintenance operations of one or more modular elements 10, 10', 10" . . . may be very easy and rapid.

In particular, the cross formation of the modular element 10 may include, on the opposite side to the plate-shaped element 20, that is in correspondence with the functional zone 30, one or more longitudinal channels 42 defining the seats 40 for the insertion of the elongated members 61.

More in detail, the longitudinal channel 42 may have a generally "U"-shaped section and may be at least partially open in correspondence with the plane $\pi_2$ so as to allow the insertion/removal of the anchoring members 61 thereof.

Figure 25A:
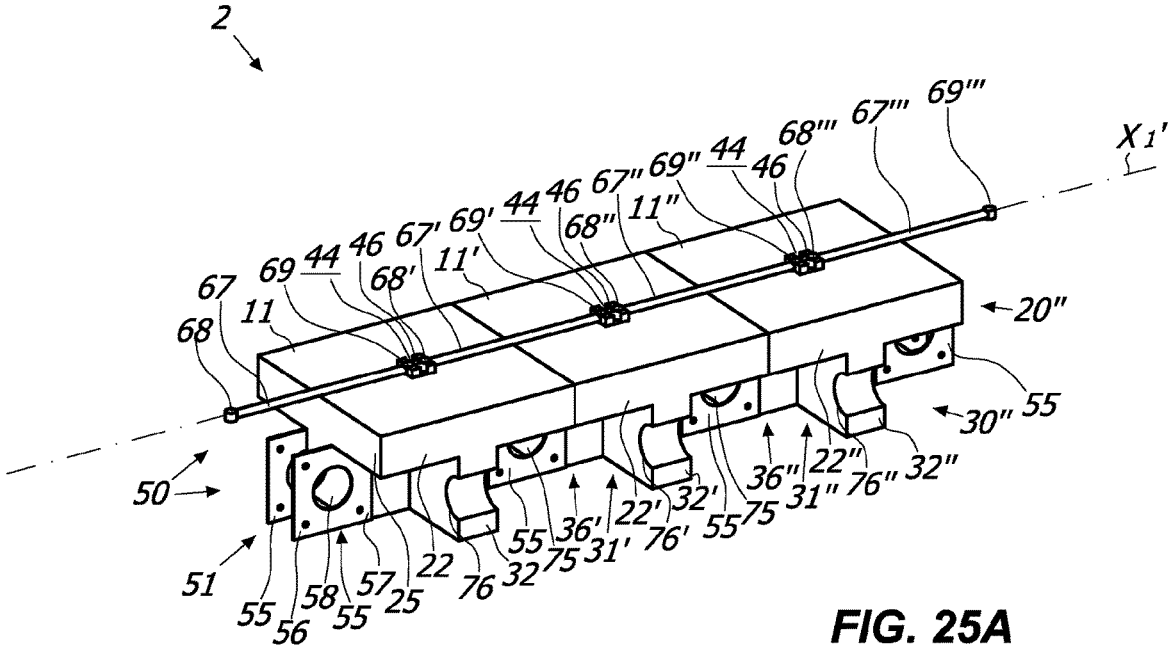
Figure 25B:
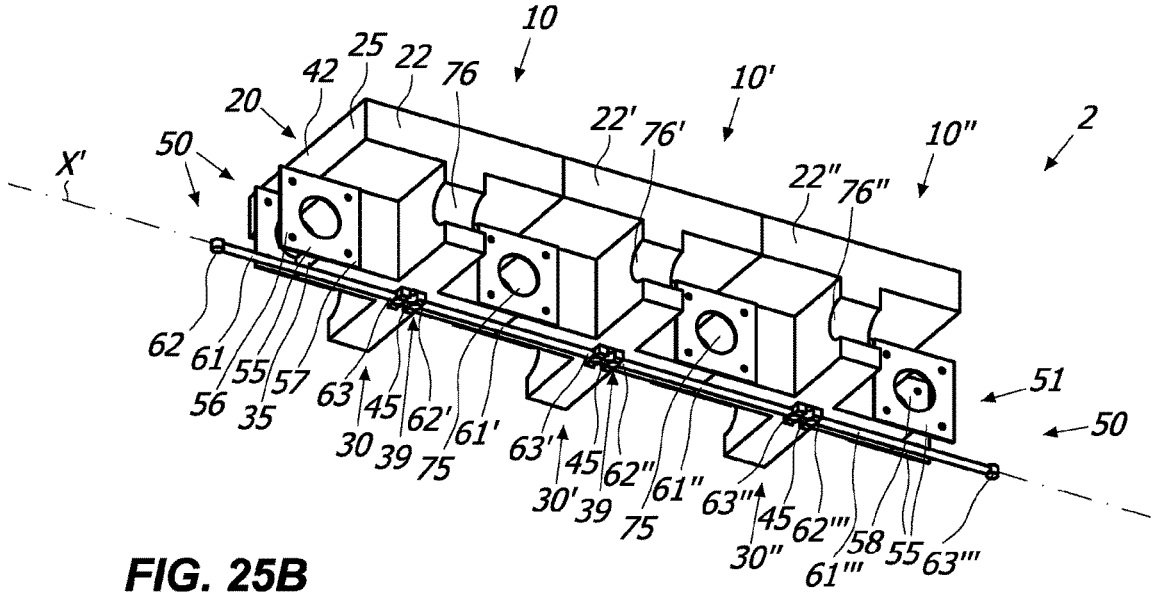

According to some embodiments, as shown in the FIGS. 25A, 25B and 26, the modular element 10 may be without channels 42.

According to another aspect of the invention, each functional zone 30 may comprise four housings 41 to allow the coupling of four anchoring members 61.

In particular, as shown in the FIGS. 29A and 29B, it may be foreseen a metallic plate 45 including the housings 41.

Said metallic plate 45 may be integrated into the central zone 39 of the functional zone 30 of each modular element 10, as shown for example in the FIGS. from 18A to 24B, so that the anchoring members 61 remains flush with the plane $\pi_2$. On the other hand, in the embodiments without channels 42 the metallic plate 45 may be simply laid on and if needed coupled with the central zone 39 of the functional zone 30 of each modular element 10, as shown for example in the FIGS. 25A and 25B.

Conveniently, in the embodiments shown in the FIGS. 18B, 19B, 22A, 22B, 23A, 23B, 25A, 25B, the opposite ends 62, 63 of the anchoring members 61 may have a predetermined shape, while the housings 41 may have a corresponding counter-profile.

Said coupling may be of removable type.

According to a different embodiment, shown in the FIGS. 20B, 21B, 24A, 24B, 28A and 28B, each anchoring member 61 may comprise two portions 64, 65 joined each other by a central sleeve 66 for the regulation of the reciprocal traction between the same portions 54, 65.

In particular, one of the portions 64, 65 may have a right thread and the other portion may have a left thread. On the other hand, the sleeve 66 may comprise counter-threading so that the sleeve 66 itself is screwable with just one turning movement.

In this way the operator may regulate the traction between the two adjacent modular elements 10, 10' through only the rotation of the sleeve 66.

According to a particular embodiment shown in the FIG. 26, the anchoring members 61 may comprise metallic members placed in correspondence with the edges 14 of the functional zone 30. In particular, each member 61 may be fastened to at least two modular elements 10, 10', preferably consecutive each other.

For example, in order to couple the members 61 of the modular elements 10 clips, screws, spikes or similar may be foreseen.

Conveniently, said members 61 may have a longitudinal development and be placed along the axis X', X", X" and the axis Y', Y", Y'" in a way similar to what described above for the elongated members 61.

Said arrangement may be preferably arranged in case that the modular element 10 is in wood.

More in general, the arrangements shown in the FIGS. 18A, 18B, 20A, 20B, 22B, 23B, 24B, 25A, 25B, 26, 30, 31, 33, 34, 35A, 35B, 36 and 37 are particularly suitable for a modular element manufactured in wood, the arrangements shown in the FIGS. 19A, 19B, 21A, 21B, 22A, 23A, 24A and 32 are particularly suitable for a modular element manufactured in plastic material, while the arrangement shown in FIG. 27 may be particularly suitable for a modular element manufactured in metallic material.

Besides this, thanks to the particular cross arrangement of the functional zone 30, the structure 1 may then achieve high rigidity both along the transverse direction defined by the axis Y and along the longitudinal direction defined by axis X.

In fact, as described above, after the bending of one or more parts of the structure 1, tensile and compressive stresses may be generated, which may act along different planes in a known way and schematically shown in the FIGS. 7, 8A and 8B.

For example, after applying a load, the beam 2 may bend so that compressive stresses act on the upper portion in correspondence with the plane $\pi_1$, while tensile stresses act on the lower portion in correspondence with the plane $\pi_2$.

Conveniently, then, the compressive stresses may be counteracted through the reciprocal contact of the portions 15 of the sides 12 of the modular elements 10 as described above, while the anchoring members 61 may be placed in proximity to the plane $\pi_2$ in order to counteract the tensile stresses.

Conveniently, the plane $\pi_2$ may be spaced apart from the plane $\pi_1$ so as to keep functionally separated from each other the zone withstanding the traction and that withstanding the compression.

In particular, as shown above, the two planes $\pi_1$, $\pi_2$ may be at the opposite ends of the modular element 10 so as to maximize the effects of withstanding the compressive and/or tensile stresses.

Besides this, the symmetry of the cross formation of the modular element 10 and the arrangement of the anchoring members 61 as described above may allow the orientation of the modular element 10 in any direction along the transverse axis X and longitudinal axis Y without compromising the structural functionality of stress withstanding.

Thanks to this feature, it may be possible to manufacture a structure 1 with only one arrangement of the modular element 10 so as to reduce time and costs of manufacturing, transportation and installation.

Even though it has been described an example in which the compressive stresses substantially act along the first plane $\pi_1$ and the tensile stresses substantially act along the flat plane $\pi_2$, it is understood, as known, that some structures 1, for example an attic 3, may be subject to tensile and/or compressive stresses in their different parts of the same plane.

More in detail, the plane $\pi_1$ of the modular element 10 may be crossed in some zones of the attic 3 by compressive stresses and in other zones thereof by tensile stresses. On the other hand, the plane $\pi_2$ may be crossed in the corresponding zones by respectively tensile or compressive stresses. In other words, the compressive and/or tensile stresses may transfer along both the plane $\pi_1$ and the plane $\pi_2$.

Concerning the compressive stresses, when acting along the plane $\pi_1$, one or more of the side portions 22, 23, 24, 25 of the plate-shaped element 20 may define the portions 15 of the faces 12 intended to come into contact with one or more of the respective side portions 22', 23', 24', 25' of the respective plate-shaped element 20' of one or more adjacent modular elements 10'.

On the other hand, when the compressive stresses act along the plane $\pi_2$, one or more of the side portions 32, 33, 34, 35 of the functional zone 30 may define the portions 15 of the faces 12 intended to come into contact with the respective side portions 32', 33', 34', 35' of the respective functional zone 30' of one or more adjacent modular elements 10'.

Concerning the tensile stresses, when these act along the plane $\pi_2$, these may be counteracted by the anchoring means 61 as described above.

Figure 22A:
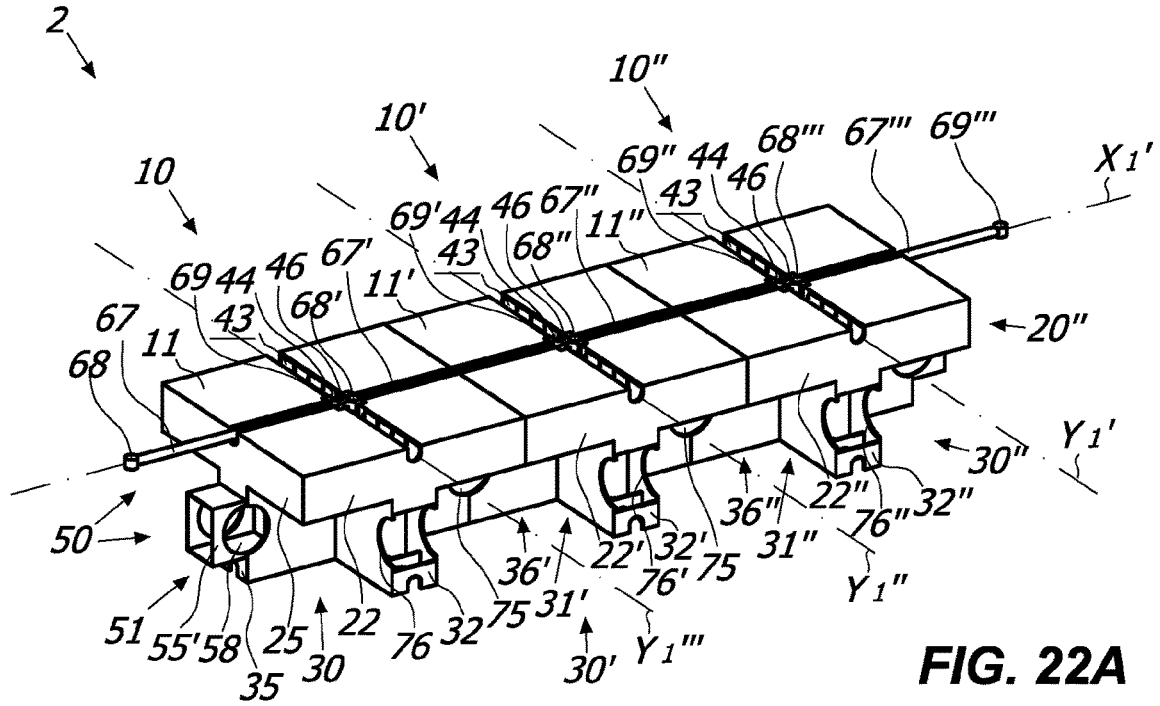
Figure 22B:
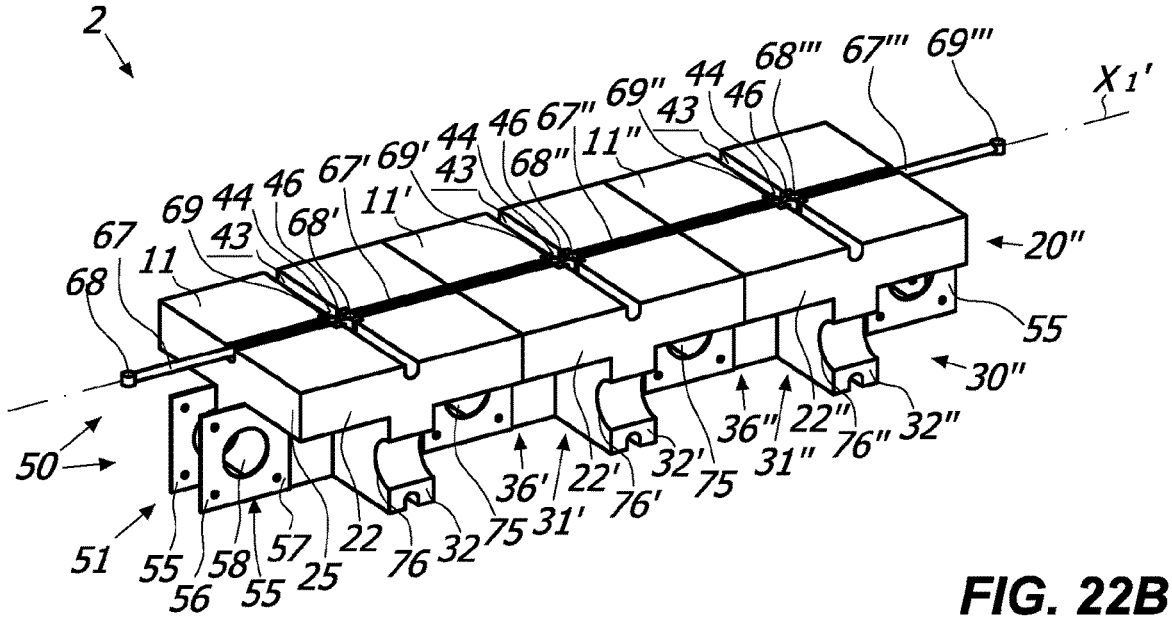
Figure 23A:
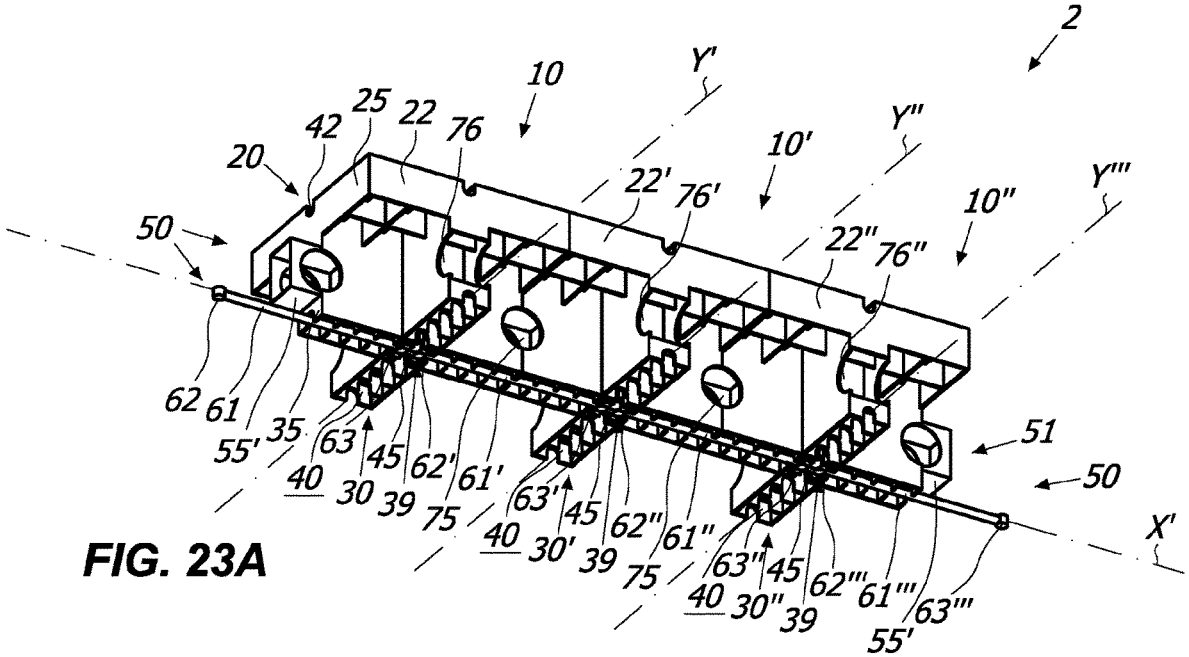
Figure 23B:
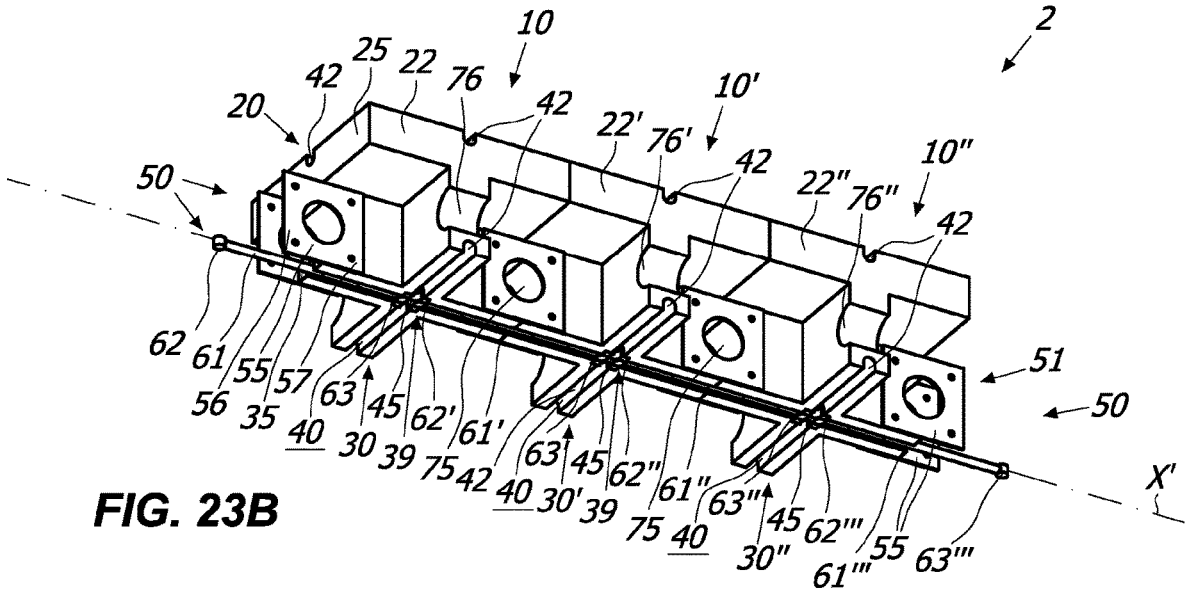
Figure 24A:
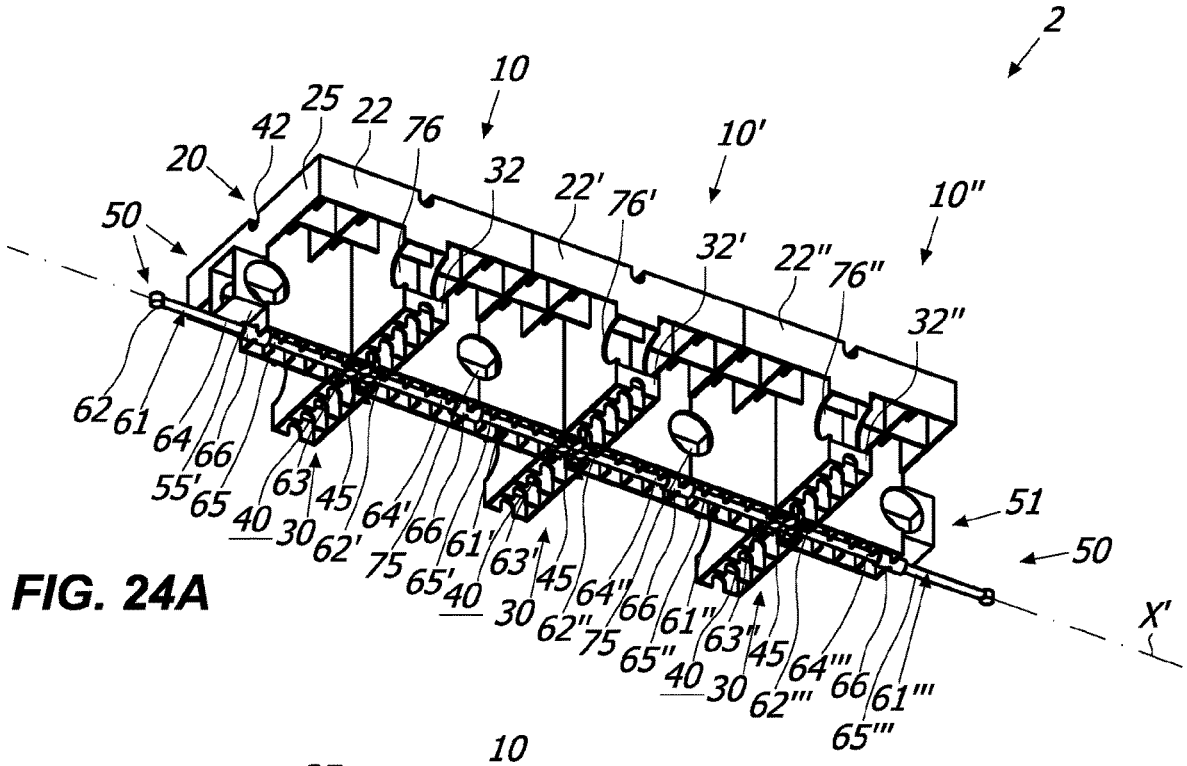
Figure 24B:
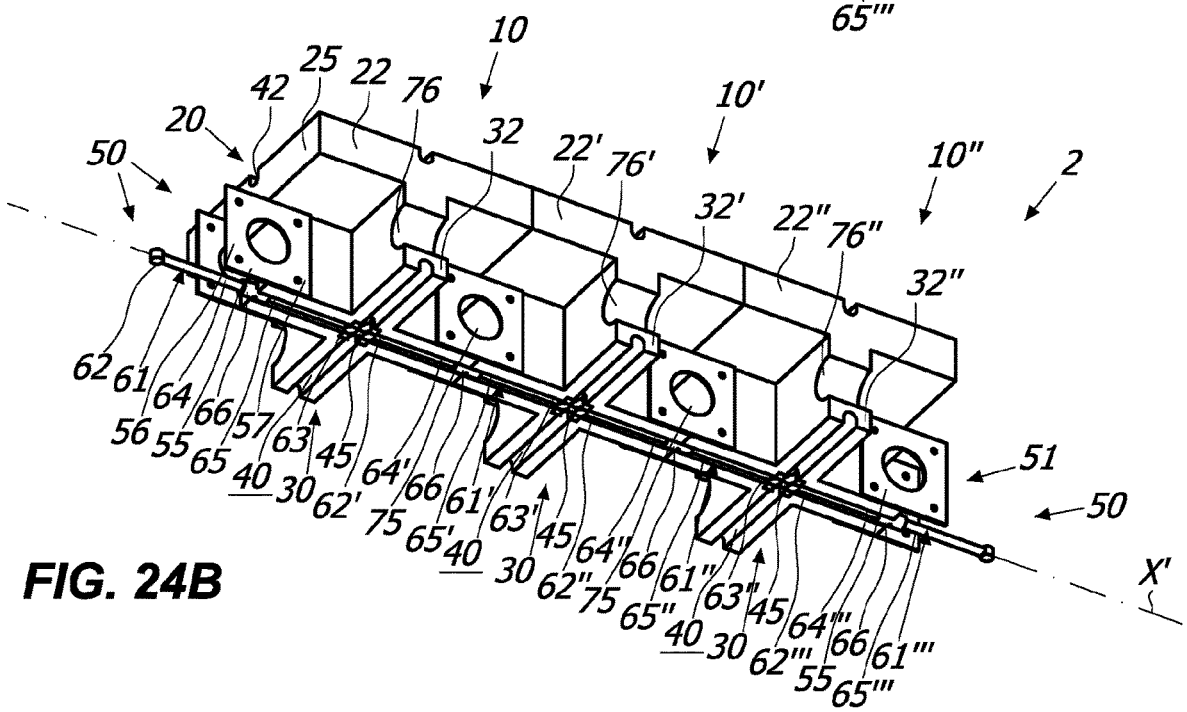

On the other hand, when the tensile stresses act on the plane $\pi_1$, further anchoring means may be foreseen 67, as shown in FIGS. 22A, 22B and 25A.

In particular, the anchoring means 67 may act along axis $X_1'$, $X_1''$, $X_1'''$ . . . each other substantially parallel and/or along axis $Y_1'$, $Y_1''$, $Y_1'''$ . . . each other substantially parallel.

Conveniently, the axis $X_1'$, $X_1''$, $X_1'''$ . . . and the axis $Y_1'$, $Y_1''$, $Y_1'''$ . . . may be each other transversal and preferably substantially perpendicular, so as to give high rigidity to the structure 1.

According to an aspect of the invention, the axis $X_1'$, $X_1''$, $X_1'''$ . . . and the axis $Y_1'$, $Y_1''$, $Y_1'''$ . . . may be placed each along a plane substantially coinciding with the plane $\pi_1$. In other words, the anchoring means 67 may form a net substantially placed along such plane $\pi_1$.

In particular, as shown in the FIGS. 18A, 19A, 20A, 21A, 22A, 22B, the modular elements 10 may comprise a seat 43. Conveniently, the latter may be arranged and/or positioned so that the axis $X_1'$ and/or the axis $Y_1'$ lie along said plane $\pi_1$.

More in particular, the seat 43 may comprise one or more housings 44 to house at east one portion of at least one of the anchoring means 67, for example one of the opposite ends 68, 69 of these latter.

As shown in the FIG. 22A e 22B and, in a similar way, at the opposite ends 62, 63 of the anchoring means 61, the opposite ends 68, 69 of the latter and the housings 44 may be reciprocally shaped so as to wedge together in a removable way.

Possibly, a second plate 46 (FIG. 29A) may be foreseen, substantially similar to the metallic plate 45 (FIG. 29B), comprising said housings 44.

The seat 43, which may be arranged in a substantially similar way to the seat 40, may be configured and/or positioned so that the anchoring means 67 are substantially placed in the plane $\pi_1$.

Conveniently, the seat 43 may be at least partially accessible in correspondence with the plane $\pi_1$ to allow the insertion/the removal of the anchoring means 67 therein/therefrom without uncoupling the modular elements each other 10, 10', 10".

More in detail, the plate-shaped element 20 may comprise one or more seats 43, each thereof may be defined by one or more housings 44 and one or more longitudinal channels 42. These latter may at least be partially open in correspondence with the plane $\pi_1$ so as to allow the insertion/removal of the anchoring means 67 in/from the respective seats 13.

According to another aspect of the invention, in order to couple the opposite ends 68, 69' of two consecutive anchoring elements 67, 67' the metallic plate may be foreseen 46.

According to a further aspect of the invention shown in particular in FIG. 34B, each anchoring element 67 may comprise two portions 70, 71 joined each other by a central sleeve 66 for regulating the mutual traction between the same portions 70, 71.

The latter may be conveniently threaded in a way similar to the portions 64, 65 of the anchoring means 61 so that the sleeve 66 is screwable with only one rotary movement.

In this way, the operator may regulate the traction between two adjacent modular elements 10, 10' in a simple and immediate way.

The system may then comprise the anchoring means 61 placed in one or more seats 40 and/or the anchoring means 67 placed in one or more seats 43 according to the requirements, in order to give high structural resistance to the support structure 1 with a material saving.

Thanks to these features, the modular elements 10, 10' . . . may be orientated in any way during the installation and then anchored through the anchoring means 61, 67, which may be placed in a convenient way, as described above, according to the requirements.

Thanks to the features here above, furthermore, it is possible to realize support beams, attics, balconies or roof pitches, and more in general, structures suitable for supporting normal loads on the main development floor.

Besides this, the operator may arrange the modular elements 10, 10' . . . so as to give to the structure 1 an aesthetically pleasant aspect without jeopardizing the structural functionalities.

According to a different aspect of the invention, the structure 1 may be realized through modular elements 10 having the arrangements discussed above.

In particular, as shown in particular in the FIGS. 31, 32, 33 and 34, edge elements 110 FIGS. 16A and 16B) may be foreseen and/or the angular elements 210 (FIG. 17A, 17B) placed in proximity to the edges and/or to the corners of connection between a beam and/or wall with a column and/or attic.

In this way, it may be possible to manufacture complex structures of high aesthetic impact.

According to a further aspect of the invention, the anchoring means 50 may include at least another anchoring means 51 susceptible to join two adjacent modular elements 10, 10' so as to counteract the shear stresses.

For example, as shown in particular in the FIGS. 28A and 28B and 36, the anchoring elements 51 may include plates 55 each thereof may be connected to two adjacent modular elements 10, 10'.

In particular, in the embodiment of FIG. 28A, the two plates 55 may be monolithic each other so as to form one unique anchoring element 55', in the embodiment of FIG. 28B the plates 55 may act in pairs from opposite sides of the planar plates 31, 36, and in the embodiment of FIG. 36 the plate 55 may be single and inserted in a groove which is central with respect to the planar plates 31, 36.

Advantageously, the anchoring member 51 may be perforated, as better explained hereinafter.

In a preferred but not exclusive embodiment of the invention, the anchoring members 51 may be the only anchoring members to the structure 1. In other words, the modular elements 10 may be anchored each other exclusively by means of the plates 55, without the necessity of elongated anchoring members 61 and/or 67. Said embodiment may be preferred in case of structure intended not to undergo excessive stresses, as in the case of structures aimed at a temporary human occupation, as for example a fair stand.

In any case, the anchoring member 51 may have at least one first portion 56 coupled with the functional zone 30 of a modular element 10 *e* and a second portion 57 coupled with the functional zone 30' of an adjacent modular element 10'.

According to a further aspect of the invention, the anchoring members 51 may be placed in proximity to the planar plates 31, 36 of two adjacent modular elements 10, 10'. In particular, each anchoring element 51 may be placed so that the portion 56 thereof may be coupled to the planar plate 31 of a modular element 10, while the portion 57 may be coupled to the planar plate 31' of the adjacent modular element 10'.

According to a different aspect of the invention, each modular element 10 may include a plurality of service holes 75. The latter may be particularly convenient for the passage of cables and/or ducts so as to allow, for example, the realization of hydraulic systems, electrical plants, drainage systems, and similar plants normally present in household and/or industrial buildings.

In particular, the passage holes 75 may be formed in correspondence with the functional zones 30 of the modular elements 10, 10', 10" . . . and that is on the opposite side to the plane $\pi_1$.

As shown in particular in FIGS. 15A and 15B, at least one lateral side 12 of the modular element 10, preferably at least two opposite side faces 12 thereof, may comprise one service hole 75 to allow the passage of pipes.

Even though not shown in the appended figures, it is understood that the embodiments of the modular element 10 described above and shown in the FIGS. from 9A to 12B, may comprise at least one service hole 75 passing through one or more of the planar plates 31, 36.

On the other side, according to a particular embodiment, shown in the FIGS. 13A, 13B, 14A, 14B, the functional zone 30 of the modular elements 10 may include at least one recess 76 intended to couple with at least one corresponding recess 76' of the adjacent modular element 10' to define the service holes 75.

Conveniently, the functional zones 30 may be opened or covered by means of removable panels so as to allow one operator to have access to the service holes 75 without dismounting the structure 1.

In this way, the maintenance operations of the plants may be facilitated. In particular, it is not necessary neither to remove nor to break the modular elements.

Conveniently, furthermore, the anchoring members 51 may have one or more holes 68. In particular, the anchoring members 51 may be placed in correspondence with the recess 76 so that the aperture 58 of the anchoring members 51 substantially coincides with the service holes 75.

More in particular, the anchoring members 51 may be placed between two modular elements 10, 10' adjacent in correspondence with the recesses 76, 76' thereof. For example, each of the anchoring members 51 may correspond to the portions 56, 57 between the respective functional zones 30, 30' of two adjacent modular elements 10, 10'.

More in detail, one between the portions 56, 57 may be in contact with one of the side portions 32, 33, 34, 35 of the functional zone 30 of one modular element 10, while the other between the portions 56, 57 may be in contact with one among the side portions 32', 33', 34', 35' of the functional zone 30 of the adjacent modular element 10'.

For example, as shown in FIG. 28B, in which the anchoring members 51 may include a pair of plates 55 facing each other, the latter may be placed so that the respective side portions 32, 33, 34, 35 of the functional zones 30 remain interposed between the pair of plates 55 itself.

On the other side, in the embodiment of FIG. 36 in which the anchoring members 51 may include one single plate 55, the latter may be placed so that the respective side portions 32, 33, 34, 35 of the functional zones 30 remain interposed between the plate 55 itself.

In order to reciprocally couple the plates 55 and the side portions 32, 33, 34, 35 of two adjacent modular elements 10, 10' screws, spikes or similar fastening means may be foreseen.

On the other side, according to a different embodiment shown in particular in FIG. 28A, the anchoring means 51 may comprise metallic longitudinal elements 55' of substantially parallelepiped shape, which may comprise two ends 56, 57 and one substantially cylindrical or tubular portion defining an aperture 58 which may coincide with the service holes 75.

Each metallic longitudinal element 55' may be formed by two plates 55 facing each other joined by two transverse elements also facing each other.

In this case, the side portions 32, 33, 34, 35 of the functional zone 30 of a modular element 10 may comprise a seat 59 for the ends 56, 57 of the longitudinal element 55' so that the latter may define a body intended to be inserted at least partially in said seats 59 in order to couple two adjacent modular elements 10, 10'.

Thanks to said features, the mutual sliding of two adjacent modular elements 10, 10' may be avoided. In other words the shear stresses may be counteracted in order to guarantee a high rigidity of the structure 1.

Also the metallic longitudinal elements 55' and/or the plates 55 may be accessible by the operator so as to facilitate the maintenance and/or replacement operations of the modular elements 10.

According to a further aspect of the invention shown in the FIGS. 31, 32, 33, 34A and 34B, two modular elements 10, 10' may be coupled each other so that the respective planar walls 11, 11' thereof may each define a respective main development plane $\pi_1$, $\pi_1'$ each other substantially perpendicular. In other words, the two modular elements 10, 10' may be substantially perpendicular each other.

Thanks to said feature, the structure 1 may comprise one or more structures with vertical development, such as a wall or a column, and one or more structures with horizontal development, such as an attic, a balcony or a beam, each other reciprocally coupled.

In other words, by using the same modular elements 10 structures 1 may be realized having different main development planes, such as a garage or a building.

Besides this, as shown in particular in FIG. 33, the different attics or walls 3 of the structure 1 may be connected through edge elements 110 having different angles depending on the requirements, so as to allow the realization of both a flat attic and of inclined roof pitches.

Conveniently, the structure 1 may be dismounted and remounted in a different way by using the same modular elements 10.

In any case, the modular elements 10 may equally transfer the compressive, tensile and shear stresses so as not to compromise the stability of the structure 1.

For example, as especially shown in the FIGS. 33 and 34, the lower edge 14 of a modular element 10 may stand on one of the side portions 22', 23', 24', 25' of the adjacent plate-shaped element 10' for counteracting the compressive stresses.

Conveniently, the elongated elements 61 may act along axis Z', Z'', Z''' substantially transverse, preferably perpendicular, to the axis X', X'', X''' and to the axis Y', Y'', Y''' so as to contrast the tensile stresses acting along the different axis.

For the purpose, the metallic plate 45 *e/o* 46 may have different arrangements so as to house the ends 62, 63 of the elongated elements 61 depending on whether these latter are placed along one or more axis X', X'', X''', Y', Y'', Y''', Z', Z'', Z'''.

In other words, the modular elements 10 may be reciprocally coupled so as to counteract the stresses, and then the tensile, compressive and shear stresses generating in the structure 1, acting on the structure 1 itself along any direction.

Furthermore, as shown in FIG. 33, the plates 55 may be shaped so that the portions 56, 57 lie on two modular elements 10, 10' placed perpendicular each other as described above.

According to a further aspect of the inventions, the structure 1 may be anchored to the ground. For example, as schematically shown in the FIGS. 31, 32 and 34, the elongated elements 61 may penetrate into the soil or into the foundations of a house.

Possibly, also the plates 55 may be configured to allow the mutual anchoring of the soil and of the modular element 10. In particular, the first may be configured so as to have the first portion 56 coupled to the modular element 10 and the second portion 57 anchored to the soil in a known way, for example through a system of screws and bolts.

Thanks to the characteristics described above, the structure 1 may be particularly stable.

The modular element 10 may be monolithic or realized through the coupling of one or more pieces, without departing from the scope of the invention.

Furthermore, the modular element 10 may be substantially full or may comprise a reticular structure, ribs, lamellas or similar, without departing from the scope of the invention.

Figure 14A:
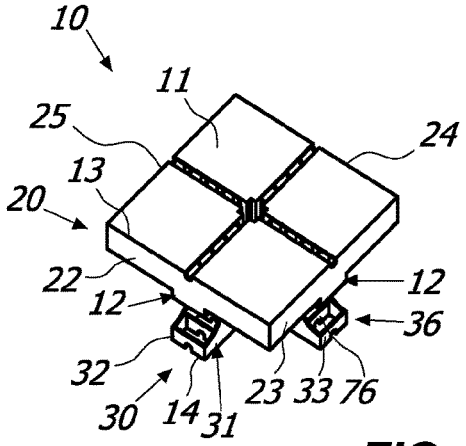
Figure 14B:
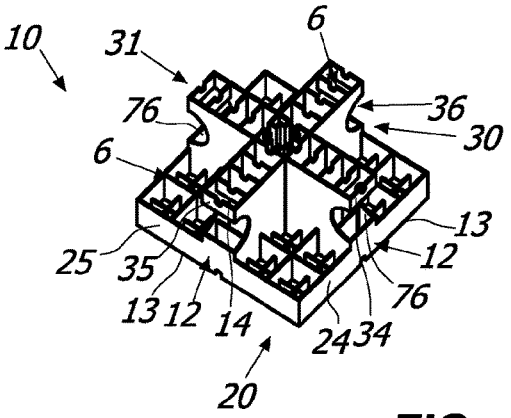

For example, when the modular element 10 is manufactured in plastic material, as for example shown in FIG. 14B, the plate-shaped element 20 may comprise a plurality of ribs or lamellas 6 substantially placed crossed so as to give to the modular element 10 lightness features and, at the same time, high mechanical resistance.

In such a way, the manufacturing, transportation and installation operations are easy, fast and cheap.

In some preferred but not exclusive embodiments of the invention, as shown for example in the FIGS. 38 and 39, the plate-shaped element 20 may be perforated, it may then include one or more holes or apertures with predetermined dimensions.

For example, in the embodiment of FIG. 38 the plate-shaped element 20 may include holes with relatively large diameter, comparable to that of the holes 75, which may be useful for the passage of cables, pipes, cable ducts or in general as service holes across an attic.

On the other side, in the embodiment of FIG. 39 the plate-shaped element 20 may be a grid, for example in metal or plastic. Said embodiment lightens the weight of the modular element 10, they guarantee, nonetheless, a good mechanical resistance.

From what described above, it is self-evident that the invention reaches the intended purposes.

The invention is susceptible of numerous modifications and variations. All the details may be replaced with other technically equivalent elements, and the materials may be different according to requirements, without departing from the scope of the invention defined in the appended claims.

The invention claimed is:

1. A modular system for dry building of structures, comprising:

a plurality of modular elements; and anchoring members of the modular elements, wherein each of the modular elements includes:

a rectangular-shaped base having an upper or lower planar wall and four planar side walls, each side wall being perpendicular to the upper or lower planar wall, the side walls including a two first side walls parallel to each other and a two second side walls parallel to each other and perpendicular to the first side walls; and a rectangular-shaped plate perpendicularly projecting from the planar wall, the rectangular-shaped plate including a planar lower or upper edge opposite to the upper or lower planar wall and two opposite planar side edges parallel to each other, each planar side edge being perpendicular to the lower or upper planar edge, wherein the anchoring members are adapted to anchor each of the plurality of modular elements to an adjacent one of the plurality of modular elements, the upper or lower planar walls of the adjacent ones of the plurality of modular elements being coplanar with each other to form a plane of a planar structure to be built, at least one of the side walls and at least one of the side edges of each of the adjacent ones of the plurality of modular elements being in mutual contact, wherein the anchoring members include a plurality of perforated anchoring plates placed at the rectangular-shaped plates of two adjacent ones of the plurality of modular elements, each of the perforated anchoring plates having an aperture at a corresponding service hole.

2. The modular system according to claim 1, wherein each the at least one of the side edges is coplanar with a respective first side wall.

3. The modular system according to claim 1, wherein the planar lower or upper edge of each of the adjacent ones of the plurality of modular elements is parallel to the upper or lower planar wall.

4. The modular system according to claim 3, wherein the planar lower or upper edges of the adjacent ones of the plurality of modular elements are coplanar to each other.

5. The modular system according to claim 1, wherein the rectangular-shaped base has a square shape.

6. The modular system according to claim 1, wherein each of the plurality of modular elements includes a plurality of service holes for passage of cables or ducts.

7. The modular system according to claim 6, wherein the service holes are defined in proximity of the side edges.

8. The modular system according to claim 7, wherein each side edge of the rectangular-shaped plate in the plurality of modular elements includes a U-shaped recess adapted to be coupled with a corresponding U-shaped recess formed at the side edge of the rectangular-shaped plate of an adjacent one of the plurality of modular elements to define one of the service holes.

9. The modular system according to claim 1, wherein each of the perforated anchoring plates has a first portion at the rectangular-shaped plate of one of the two adjacent ones of the plurality of modular elements and a second portion at the rectangular-shaped plate of another one of the two adjacent modular elements.

10. The modular system according to claim 1, wherein each of the plurality of modular elements has the rectangular-shaped base and the rectangular-shaped plate removably coupled to each other.

11. A modular system for dry building of structures, comprising:

a plurality of modular elements; and anchoring members of the modular elements, wherein each of the modular elements includes:

a rectangular-shaped base having an upper or lower planar wall and four planar side walls, each side wall being perpendicular to the upper or lower planar wall, the side walls including two first side walls parallel to each other and two second side walls parallel to each other and perpendicular to the first side walls; and a rectangular-shaped plate perpendicularly projecting from the upper or lower planar wall, the rectangular-shaped plate including a planar lower or upper edge opposite to the upper or lower planar wall and two opposite planar side edges parallel to each other, each planar side edge being perpendicular to the lower or upper planar edge, wherein the anchoring members are adapted to side-by-side anchor each of the plurality of modular elements to an adjacent one of the plurality of modular elements, the upper or lower planar walls of the adjacently disposed modular elements being coplanar with each other to form a plane of a planar structure to be built, at least one of the side walls and at least one of the side edges of each of the adjacent modular elements being in mutual contact, wherein said anchoring members are removable, wherein each of the modular elements includes a seat to seat a portion of the anchoring members, and wherein said seat is a U-shaped open seat arranged at the upper or lower planar wall or the planar lower or upper edge to allow insertion or removal of the anchoring members.

12. The modular system according to claim 11, wherein the anchoring members includes a plurality of elongated anchoring rods each defining a respective axis laying on the upper or lower planar wall or on the planar lower or upper edge.

13. The modular system according to claim 12, wherein the elongated anchoring rods and the seats are reciprocally adapted so that each end of the elongated anchoring rods are located at a central zone of the upper or lower planar wall or of the planar lower or upper edge.

14. A modular system for dry building of structures, comprising:

a plurality of modular elements; and anchoring members of the modular elements;

wherein each of the modular elements includes:

a rectangular-shaped base having an upper or lower planar wall and four planar side walls, each side wall being perpendicular to the upper or lower planar wall, the side walls including two first side walls parallel to each other and two second side walls parallel to each other and perpendicular to the first side walls; and two rectangular-shaped plates that are perpendicular and crossed to each other to form a cross formation perpendicularly projecting from the upper or lower planar wall, each rectangular-shaped plate including a planar lower or upper edge opposite to the upper or lower planar wall and two opposite planar side edges parallel to each other, each planar side edge being perpendicular to the lower or upper planar edge, wherein the anchoring members are adapted to side-by-side anchor each of the plurality of modular elements to an adjacent one of the plurality of modular elements, the upper or lower planar walls of adjacent modular elements being coplanar with each other to form a plane of a planar structure to be built, at least one of the side walls and at least one of the side edges of each of the adjacent modular elements being in mutual contact.

15. The modular system according to claim 14, wherein the at least one of the side edges is coplanar with a respective first side wall.

16. The modular system according to claim 15, wherein the rectangular-shaped plates are arranged so that one of the rectangular-shaped plates is perpendicular and the other one of the rectangular-shaped plates is parallel to each of the four planar side walls.

17. The modular system according to claim 16, wherein the planar lower or upper edges of adjacent modular elements are coplanar with each other.

* * * * *